US012246901B2

(12) United States Patent
Mills et al.

(10) Patent No.: US 12,246,901 B2
(45) Date of Patent: Mar. 11, 2025

(54) SHIPPING AND DISPENSING CONSTRUCT

(71) Applicant: Graphic Packaging International, LLC, Atlanta, GA (US)

(72) Inventors: Karen L. Mills, Limerick, PA (US); Mark Zammit, Douglasville, GA (US); Scott Thomas Strand, Lake Elmo, MN (US)

(73) Assignee: Graphic Packaging International, LLC, Atlanta, GA (US)

( * ) Notice: Subject to any disclaimer, the term of this patent is extended or adjusted under 35 U.S.C. 154(b) by 482 days.

(21) Appl. No.: 17/354,486

(22) Filed: Jun. 22, 2021

(65) Prior Publication Data

US 2021/0403216 A1 Dec. 30, 2021

Related U.S. Application Data

(60) Provisional application No. 63/043,291, filed on Jun. 24, 2020.

(51) Int. Cl.
*B65D 77/04* (2006.01)
*B65B 5/02* (2006.01)
(Continued)

(52) U.S. Cl.
CPC ..... *B65D 77/0413* (2013.01); *B65B 5/024* (2013.01); *B65B 5/06* (2013.01); *B65D 77/30* (2013.01); *B65D 2577/043* (2013.01)

(58) Field of Classification Search
CPC ..... B65D 77/0413; B65D 77/30; B65D 2577/043; B65D 71/0085;
(Continued)

(56) References Cited

U.S. PATENT DOCUMENTS 396,570 A 1/1889 Hotchkiss
637,838 A 11/1899 Vernon
(Continued)

FOREIGN PATENT DOCUMENTS

CA 1079240 6/1980
EP 0 060 504 B1 11/1984
(Continued)

OTHER PUBLICATIONS

Colpac Vizione Cardboard Food Tray. [online] Published on Apr. 20, 2017. Retrieved Dec. 18, 2018 from URL: http://www.castawayfoodpackaging.co.nz/product/01viztfl-vizione-cardboard-food-tray.

(Continued)

*Primary Examiner* — Christopher R Demeree
(74) *Attorney, Agent, or Firm* — Womble Bond Dickinson (US) LLP

(57) ABSTRACT

A shipping and dispensing construct for engaging a plurality of product holding containers includes a plurality of panels extending at least partially around an interior of the shipping and dispensing construct and including a front panel, a top panel, at least one central panel, and at least one side panel. The shipping and dispensing construct further includes dispensing features for removal of one or more of the product holding containers, the dispensing features including a plurality of dispensing portions comprising at least a portion of the at least one central panel, the dispensing portions for being removably attached to a respective container of the plurality of product holding containers and being separable from a remainder of the shipping and dispensing construct for allowing access to the respective container of the plurality of product holding containers.

45 Claims, 17 Drawing Sheets

(51) Int. Cl.
*B65B 5/06* (2006.01)
*B65D 77/30* (2006.01)

(58) Field of Classification Search
CPC ..... B65D 2571/0066; B65D 5/5495; B65D 2571/00864; B65D 2577/047
USPC ..... 229/120.011; 206/427, 170, 174, 175, 206/747; 221/305
See application file for complete search history.

(56) References Cited

U.S. PATENT DOCUMENTS 1,373,365 A 3/1921 Smouse
1,833,605 A 11/1931 Gates, Jr.
1,892,756 A 1/1933 Van Home
2,330,521 A 9/1943 Scheide
2,341,762 A 2/1944 Conklin
2,355,729 A 8/1944 Inman
2,355,730 A 8/1944 Inman
2,359,986 A 10/1944 Grecco
2,558,713 A 6/1951 Williamson
2,662,684 A 12/1953 Robins
2,671,584 A 3/1954 Taylor, Jr.
2,684,178 A 7/1954 Keeler
2,723,027 A 11/1955 Reynolds
2,811,250 A 10/1957 Arneson
2,846,062 A 8/1958 Paige
2,872,036 A 2/1959 Forrer
2,888,132 A 5/1959 Guyer
3,027,063 A 3/1962 Zastrow
3,056,528 A 10/1962 Shiels, Jr.
3,071,244 A 1/1963 Doran
3,127,991 A 4/1964 Burnett
3,136,410 A 6/1964 Sanford
3,144,190 A 8/1964 Holt
3,158,312 A 11/1964 Simkins
3,163,351 A 12/1964 Borgardt
3,186,587 A 6/1965 Englander
3,195,850 A 7/1965 Steiner
3,263,807 A 8/1966 Fingerhut
3,315,875 A 4/1967 Rudolf
3,323,639 A 6/1967 Krzyzanowski
3,324,999 A 6/1967 Farquhar
3,326,369 A 6/1967 Tolaas
3,355,089 A 11/1967 Champlin
3,375,968 A 4/1968 Weiss
3,392,878 A 7/1968 Jackson
3,447,735 A 6/1969 Whitney
3,493,106 A 2/1970 Galli
D217,441 S 5/1970 Kanaga
3,528,598 A 9/1970 Lock
3,635,393 A 1/1972 Herglotz
3,677,458 A 7/1972 Gosling
3,756,502 A 9/1973 Swanson
3,840,171 A 10/1974 Waters
3,840,172 A 10/1974 Zimmermann
3,872,965 A 3/1975 Taub
3,886,901 A 6/1975 Zeitter
3,918,584 A 11/1975 Richardson
3,935,943 A 2/1976 Meyer
3,949,928 A 4/1976 Perkins
4,068,795 A 1/1978 Forster
4,082,215 A 4/1978 Eichenauer
D250,093 S 10/1978 Schillinger
4,170,325 A 10/1979 Pawlowski
4,192,445 A 3/1980 Card
4,252,236 A 2/1981 Roccaforte
4,277,015 A 7/1981 Crane
D260,076 S 8/1981 Schillinger
4,328,923 A 5/1982 Graser
4,340,169 A 7/1982 Webinger
4,415,082 A * 11/1983 Martin ..... B65D 5/46016 229/117.14
4,449,633 A 5/1984 Johnson et al.
D281,484 S 11/1985 Dickes
4,671,451 A 6/1987 Yeaman, Sr.
4,696,402 A 9/1987 Harmon et al.
4,790,436 A 12/1988 Nakamura
4,794,005 A 12/1988 Swiontek
4,817,866 A 4/1989 Wonnacott
4,860,944 A 8/1989 Wonnacott
4,865,187 A 9/1989 Zulauf
4,895,295 A 1/1990 Montgomery
D306,699 S 3/1990 Michau
4,905,837 A 3/1990 Schuster et al.
4,928,817 A 5/1990 Focke
4,930,633 A 6/1990 Gloyer
4,944,405 A 7/1990 Buford
4,961,501 A 10/1990 Hansmann
5,016,813 A 5/1991 Simons
5,020,663 A 6/1991 Dallas
5,044,503 A 9/1991 Wein
5,048,687 A 9/1991 Suzuki
D320,557 S 10/1991 Schuster
5,060,804 A 10/1991 Beales
5,094,359 A 3/1992 DeMars et al.
5,125,565 A 6/1992 Rogers
5,170,934 A 12/1992 Lemoine
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,505,369 A 4/1996 Taliaferro
5,520,284 A 5/1996 Gray
5,522,538 A 6/1996 Gray
5,570,808 A 11/1996 Tassoni
5,590,813 A 1/1997 Abramczyk
5,607,056 A 3/1997 Whiteside
5,675,960 A 10/1997 Weaver
5,823,350 A 10/1998 Ward
5,871,090 A 2/1999 Doucette et al.
5,871,100 A 2/1999 Ward
6,041,997 A 3/2000 Jensen
6,126,065 A 10/2000 Wee
6,155,412 A 12/2000 Le Bras
6,305,598 B1 10/2001 Bryan
D458,127 S 6/2002 De Groote
D467,499 S 12/2002 Garza et al.
D473,787 S 4/2003 Jones, Jr. et al.
6,554,135 B1 4/2003 Luceri
D478,737 S 8/2003 Sparkowski
D484,043 S 12/2003 Hwang et al.
D484,799 S 1/2004 Hoffman
6,676,010 B1 1/2004 Roseth et al.
D486,390 S 2/2004 Auclair
6,729,475 B2 5/2004 Yuhas et al.
D495,953 S 9/2004 Miller
6,808,107 B2 10/2004 Jackson
D505,620 S 5/2005 Huebsch
6,938,818 B2 9/2005 Moorman
6,981,631 B2 1/2006 Fogle et al.
D515,942 S 2/2006 Hamblin
D519,366 S 4/2006 Epstein
7,021,525 B2 4/2006 Jouppi et al.
D519,830 S 5/2006 Yocum
7,097,041 B2 8/2006 Marrale
7,234,593 B2 6/2007 Fath
D561,023 S 2/2008 Jacxsens
7,380,701 B2 6/2008 Fogle et al.
D590,244 S 4/2009 Demalsche
7,552,820 B2 6/2009 Kohler
7,624,911 B2 12/2009 Spurrell
7,669,755 B2 3/2010 Smalley
7,699,214 B2 4/2010 Mestre et al.
D622,589 S 8/2010 Elias
D629,296 S 12/2010 De Muynck
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
D637,078 S 5/2011 Peng
7,938,257 B2 5/2011 Kohler
8,028,839 B2 10/2011 Learn

(56) References Cited

U.S. PATENT DOCUMENTS

| | | | |
|---|---|---|---|
| D656,394 | S | 3/2012 | Smith |
| D666,830 | S | 9/2012 | Glenn |
| D668,533 | S | 10/2012 | Collins |
| D684,858 | S | 6/2013 | Sill |
| 8,701,974 | B2 | 4/2014 | Davies |
| D706,129 | S | 6/2014 | Boraczek |
| 8,740,050 | B2 | 6/2014 | Zinck et al. |
| D713,725 | S | 9/2014 | Cedeno |
| D714,149 | S | 9/2014 | Cedeno |
| D717,162 | S | 11/2014 | Baker |
| D719,018 | S | 12/2014 | Levy |
| 9,033,209 | B2 | 5/2015 | Fogle et al. |
| 9,073,658 | B2 | 7/2015 | Spivey, Sr. et al. |
| D741,175 | S | 10/2015 | Amindjanov |
| 9,162,793 | B2 | 10/2015 | Stewart |
| 9,169,037 | B2 | 10/2015 | Pinkstone |
| 9,211,971 | B2 | 12/2015 | Fogle et al. |
| 9,248,933 | B2 | 2/2016 | Spivey, Sr. et al. |
| D753,994 | S | 4/2016 | Pantelleria |
| 9,309,023 | B2 | 4/2016 | Hubbard, Jr. |
| 9,321,553 | B1 | 4/2016 | Spivey, Sr. et al. |
| D755,624 | S | 5/2016 | Ng |
| 9,346,234 | B2 | 5/2016 | Hajek et al. |
| D762,468 | S | 8/2016 | Pantelleria et al. |
| D764,271 | S | 8/2016 | Sanfilippo |
| D769,114 | S | 10/2016 | Montemayor |
| 9,505,516 | B2 | 11/2016 | Hubbard, Jr. |
| D775,947 | S | 1/2017 | Epstein |
| 9,701,438 | B2 | 7/2017 | Fitzwater et al. |
| D805,894 | S | 12/2017 | Lee |
| 9,845,182 | B2 | 12/2017 | Baldino |
| D809,930 | S | 2/2018 | Kagawa |
| D810,561 | S | 2/2018 | Garnett |
| D811,875 | S | 3/2018 | Haen et al. |
| D813,029 | S | 3/2018 | Borkovetz et al. |
| D814,296 | S | 4/2018 | Collins |
| 10,017,290 | B2 | 7/2018 | Faulkner et al. |
| 10,086,972 | B2 | 10/2018 | Hajek |
| D834,411 | S | 11/2018 | Vanderhulst |
| D838,587 | S | 1/2019 | Laliberte |
| D842,695 | S | 3/2019 | Haen |
| 10,232,973 | B2 | 3/2019 | Burke |
| 10,239,651 | B2 | 3/2019 | Exner et al. |
| D848,835 | S | 5/2019 | Exner |
| D861,484 | S | 10/2019 | Patel |
| D864,751 | S | 10/2019 | Exner |
| D864,753 | S | 10/2019 | Exner |
| D866,321 | S | 11/2019 | Bennett |
| D880,999 | S | 4/2020 | Sill |
| D887,830 | S | 6/2020 | Kirchen |
| D901,241 | S | 11/2020 | Cohen |
| D904,870 | S | 12/2020 | Sill |
| D912,508 | S | 3/2021 | Kirchen |
| D918,030 | S | 5/2021 | Wan |
| D918,036 | S | 5/2021 | David |
| D920,099 | S | 5/2021 | Stabile |
| D923,473 | S | 6/2021 | Jacobsson |
| 11,203,460 | B2 | 12/2021 | Hokanson |
| D949,010 | S | 4/2022 | Sill |
| D966,098 | S | 10/2022 | Gonzalez Manzano |
| D968,952 | S | 11/2022 | Chambers |
| D974,906 | S | 1/2023 | Vanderhulst |
| D975,540 | S | 1/2023 | Castro |
| D996,207 | S | 8/2023 | Weaver |
| 11,807,432 | B2 | 11/2023 | Weaver |
| D1,009,621 | S | 1/2024 | Houkom |
| D1,018,297 | S | 3/2024 | Mayer |
| 2004/0031842 | A1 | 2/2004 | Westerman et al. |
| 2004/0182916 | A1 | 9/2004 | Roseth |
| 2004/0226988 | A1 | 11/2004 | Fogle |
| 2004/0245327 | A1 | 12/2004 | Oliff |
| 2005/0045706 | A1 | 3/2005 | Varanasi |
| 2005/0056554 | A1 | 3/2005 | Fath et al. |
| 2005/0092649 | A1 | 5/2005 | Ford |
| 2005/0279815 | A1 | 12/2005 | Fogle et al. |
| 2006/0054671 | A1 | 3/2006 | Galkoski |
| 2006/0151585 | A1 | 7/2006 | Misjak |
| 2006/0255105 | A1 | 11/2006 | Sweet |
| 2007/0095881 | A1 | 5/2007 | Manaige |
| 2007/0141208 | A1 | 6/2007 | Nukuto |
| 2007/0295796 | A1 | 12/2007 | Sutherland |
| 2008/0087679 | A1 | 4/2008 | Cook |
| 2008/0277311 | A1 | 11/2008 | Wang |
| 2009/0039144 | A1 | 2/2009 | Hooi et al. |
| 2009/0302098 | A1* | 12/2009 | Learn ..... B65D 5/5019 220/735 |
| 2010/0108748 | A1 | 5/2010 | Fleming |
| 2011/0215110 | A1 | 9/2011 | Kadhum |
| 2011/0226847 | A1 | 9/2011 | Nakano |
| 2011/0274880 | A1 | 11/2011 | Gotschi |
| 2012/0273387 | A1 | 11/2012 | Ivosevic |
| 2012/0298732 | A1 | 11/2012 | Stewart |
| 2013/0112592 | A1 | 5/2013 | Bowers et al. |
| 2013/0140350 | A1 | 6/2013 | Noferi |
| 2013/0334096 | A1 | 12/2013 | Fath |
| 2014/0096488 | A1 | 4/2014 | Gonzalez |
| 2014/0263600 | A1 | 9/2014 | Valencia |
| 2015/0083625 | A1 | 3/2015 | Paredes et al. |
| 2016/0101917 | A1 | 4/2016 | Spivey, Sr. |
| 2016/0176569 | A1 | 6/2016 | Hanke |
| 2017/0267397 | A1 | 9/2017 | Cooper |
| 2017/0297796 | A1 | 10/2017 | Ball |
| 2019/0291932 | A1 | 9/2019 | Chevalier |
| 2020/0189818 | A1 | 6/2020 | McCree |
| 2020/0207055 | A1 | 7/2020 | Wirtz |
| 2021/0016916 | A1* | 1/2021 | Ford ..... B65D 71/36 |
| 2021/0309412 | A1 | 10/2021 | Abjean |
| 2021/0403198 | A1 | 12/2021 | Hajek |
| 2021/0403199 | A1 | 12/2021 | Weaver |
| 2021/0403217 | A1 | 12/2021 | Mills |
| 2022/0017259 | A1 | 1/2022 | Barbieri |
| 2023/0013072 | A1 | 1/2023 | Stiess |
| 2023/0356868 | A1 | 11/2023 | Scapin |
| 2023/0373675 | A1 | 11/2023 | Telman |

FOREIGN PATENT DOCUMENTS

| | | | |
|---|---|---|---|
| EP | 0 647 199 | B1 | 5/2000 |
| EP | 1 348 638 | A1 | 10/2003 |
| EP | 1 200 316 | B1 | 6/2004 |
| EP | 2 008 937 | A1 | 12/2008 |
| EP | 2 493 772 | B1 | 6/2014 |
| GB | 2 387 591 | | 10/2003 |
| JP | 3062562 | U | 10/1999 |
| JP | 2004-123101 | | 4/2004 |
| JP | 2009-073536 | | 4/2009 |
| JP | 2011-093601 | A | 5/2011 |
| KR | 20-0171748 | | 3/2000 |
| KR | 20-0450117 | Y1 | 9/2010 |
| WO | WO 89/10308 | | 11/1989 |
| WO | WO 95/25046 | A1 | 9/1995 |
| WO | WO 98/47417 | | 10/1998 |
| WO | WO 00/71427 | A1 | 11/2000 |
| WO | WO 00/78619 | A2 | 12/2000 |
| WO | WO 2010/006629 | A1 | 1/2010 |
| WO | WO 2012/148986 | A1 | 11/2012 |

OTHER PUBLICATIONS

International Search Report and Written Opinion for PCT/US2021/038431 dated Oct. 18, 2021.

International Search Report and Written Opinion for PCT/US2021/038434 dated Oct. 19, 2021.

International Search Report and Written Opinion for PCT/US2021/038438 dated Oct. 6, 2021.

International Search Report and Written Opinion for PCT/US2021/038427 dated Oct. 18, 2021.

International Search Report and Written Opinion for PCT/US2021/038435 dated Oct. 21, 2021.

U.S. Appl. No. 29/756,578, filed Oct. 29, 2020.

U.S. Appl. No. 29/756,579, filed Oct. 29, 2020.

U.S. Appl. No. 29/756,580, filed Oct. 29, 2020.

(56) References Cited

OTHER PUBLICATIONS

U.S. Appl. No. 29/756,581, filed Oct. 29, 2020.
U.S. Appl. No. 29/753,802, filed Oct. 2, 2020.
U.S. Appl. No. 17/354,468, filed Jun. 22, 2021.
U.S. Appl. No. 17/354,475, filed Jun. 22, 2021.
U.S. Appl. No. 17/354,491, filed Jun. 22, 2021.
U.S. Appl. No. 17/354,454, filed Jun. 22, 2021.
SIDEL wrap around case packer, posted at sidel.com (date not available), [site visited Oct. 16, 2023]. Available from internet, URL: <https://www.sidel.com/en/overwrapping-packing/wrap-around-blank-packing/cermex-wb-bb-pd-384> (Year: NA).
Supplementary European Search Report for EP 21 82 8680 dated Jun. 21, 2024.
Supplementary European Search Report for EP 21 82 9870 dated Jun. 25, 2024.

* cited by examiner

SHIPPING AND DISPENSING CONSTRUCT

CROSS-REFERENCE TO RELATED APPLICATION

This application claims the benefit of U.S. Provisional Patent Application No. 63/043,291, filed on Jun. 24, 2020.

INCORPORATION BY REFERENCE

The disclosures of each of U.S. Provisional Patent Application No. 63/043,291, filed on Jun. 24, 2020, and U.S. Design Patent Application No. 29/756,579, filed on Oct. 29, 2020, are hereby incorporated by reference for all purposes as if set forth in their entirety.

BACKGROUND

The present disclosure generally relates to shipping and dispensing constructs and/or cartons for holding and dispensing containers or other types of articles. More specifically, the present disclosure relates to a shipping and dispensing construct for holding and dispensing a plurality of containers such as product holding containers, the shipping and dispensing construct having features to facilitate dispensing one or more of the product holding containers.

SUMMARY

According to one aspect, the disclosure is generally directed to a shipping and dispensing construct for engaging a plurality of product holding containers, the shipping and dispensing construct comprising a plurality of panels extending at least partially around an interior of the shipping and dispensing construct and comprising a front panel, a top panel, at least one central panel, and at least one side panel. The shipping and dispensing construct further comprises dispensing features for removal of one or more of the product holding containers, the dispensing features comprising a plurality of dispensing portions comprising at least a portion of the at least one central panel, the dispensing portions for being removably attached to a respective container of the plurality of product holding containers and being separable from a remainder of the shipping and dispensing construct for allowing access to the respective container of the plurality of product holding containers.

According to another aspect, the disclosure is generally directed to a construct blank for forming a shipping and dispensing construct for engaging a plurality of product holding containers, the construct blank comprising a plurality of panels for extending at least partially around an interior of the shipping and dispensing construct formed from the construct blank and comprising a front panel, a top panel, at least one central panel, and at least one side panel. The construct blank further comprises dispensing features for removal of one or more of the product holding containers from the shipping and dispensing construct formed from the construct blank, the dispensing features comprising a plurality of dispensing portions comprising at least a portion of the at least one central panel, the dispensing portions for being removably attached to a respective container of the plurality of product holding containers and being separable from a remainder of the construct blank for allowing access to the respective container of the plurality of product holding containers when the shipping and dispensing construct is formed from the construct blank.

According to another aspect, the disclosure is generally directed to a method of forming a shipping and dispensing construct, the method comprising obtaining a construct blank comprising a plurality of panels comprising a front panel, a top panel, at least one central panel, and at least one side panel, and dispensing features comprising a plurality of dispensing portions, the plurality of dispensing portions comprising at least a portion of the at least one central panel, the dispensing portions being separable from a remainder of the blank. The method further comprises folding the plurality of panels at least partially around an interior of the shipping and dispensing construct formed from the construct blank such that the dispensing portions are positioned for being removably attached to a respective container of a plurality of product holding containers.

According to another aspect, the disclosure is generally directed to a package, the package comprising a plurality of product holding containers and a shipping and dispensing construct engaged with the plurality of product holding containers. The shipping and dispensing construct comprises a plurality of panels extending at least partially around an interior of the shipping and dispensing construct and comprising a front panel, a top panel, at least one central panel, and at least one side panel. The shipping and dispensing construct further comprises dispensing features for removal of one or more of the product holding containers, the dispensing features comprising a plurality of dispensing portions comprising at least a portion of the at least one central panel, the dispensing portions being removably attached to a respective container of the plurality of product holding containers and being separable from a remainder of the shipping and dispensing construct for allowing access to the respective container of the plurality of product holding containers.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to constructs, cartons, carriers, clips, sleeves, or the like, and packages for shipping and dispensing articles such as containers, cartons, constructs, sleeves, etc. that hold a product. The containers can be product holding containers used for packaging consumer products such as soap or other personal care products, but the product holding containers could hold other products such as food and beverage products, or any other suitable product. The product holding containers can be made from materials suitable in composition for packaging the particular consumer product or item, and the materials include, but are not limited to, paperboard, composite paperboard, and the like; plastics such as PET, LDPE, LLDPE, HDPE, PP, PS, PVC, EVOH, and Nylon, or any combination thereof, or any other suitable material.

Constructs according to the present disclosure can accommodate articles of any shape. For the purpose of illustration and not for the purpose of limiting the scope of the disclosure, the following detailed description describes product holding containers (e.g., paperboard cartons having closed ends) as associated with the shipping and dispensing construct embodiments and/ or as disposed within the construct embodiments. In this specification, the terms "inner," "interior," "outer," "exterior," "lower," "bottom," "upper," and "top" indicate orientations determined in relation to fully erected and upright constructs and cartons.

As described herein, constructs/containers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
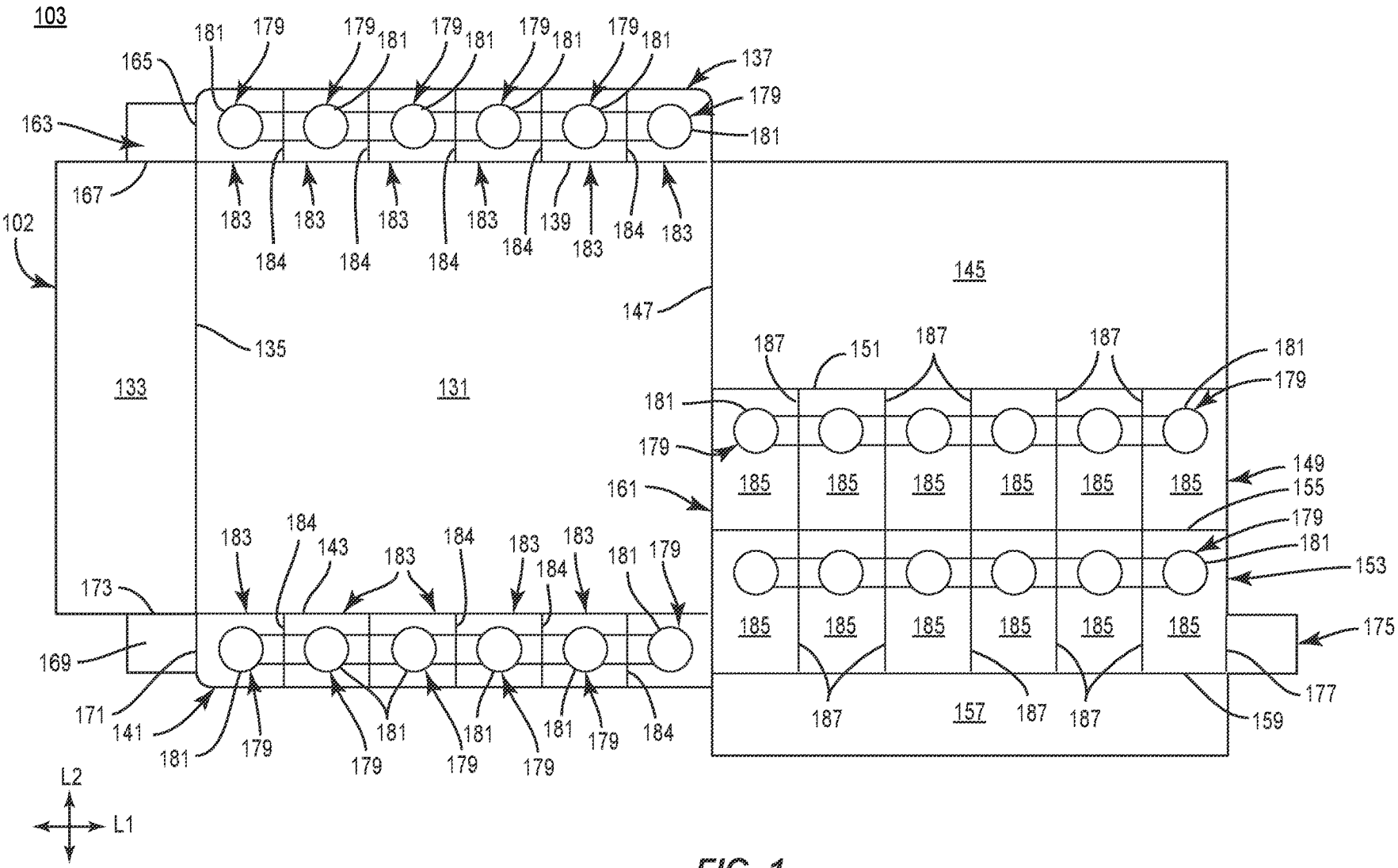
FIG. 1 is a plan schematic view of a construct blank for forming a shipping and dispensing construct according to a first exemplary embodiment of the disclosure.

FIG. 1 is a plan view of an interior surface 102 of a construct blank 103 used to form a shipping and dispensing construct 105 (FIG. 2) according to a first exemplary embodiment of the disclosure. The construct 105 can be used to at least partially hold/retain a plurality of product holding containers C securely for shipping from the product holding container supplier to a point-of-sale vendor (e.g., department store, grocery store, pharmacy, etc.) where the construct can be displayed for purchase by a consumer.

In one embodiment, the construct 105 has attachment features for securely attaching the product holding containers C to the construct 105 and can also include dispensing/separating features for allowing the respective product holding containers C to be released or dispensed from the construct 105 by the consumer. It will be understood that, in one or more embodiments, one or more of the attachment features can be separable/removable from one or more other portions of the construct 105 so as to also be considered dispensing features of the construct 105.

In one embodiment, twelve product holding containers C are contained in the construct 105 and can be arranged in two rows of two containers stacked in three tiers (e.g., 2×2×3), but more or less than twelve product holding containers C can be contained in the construct 105 and the product holding containers can be differently arranged without departing from the disclosure.

Figure 5:
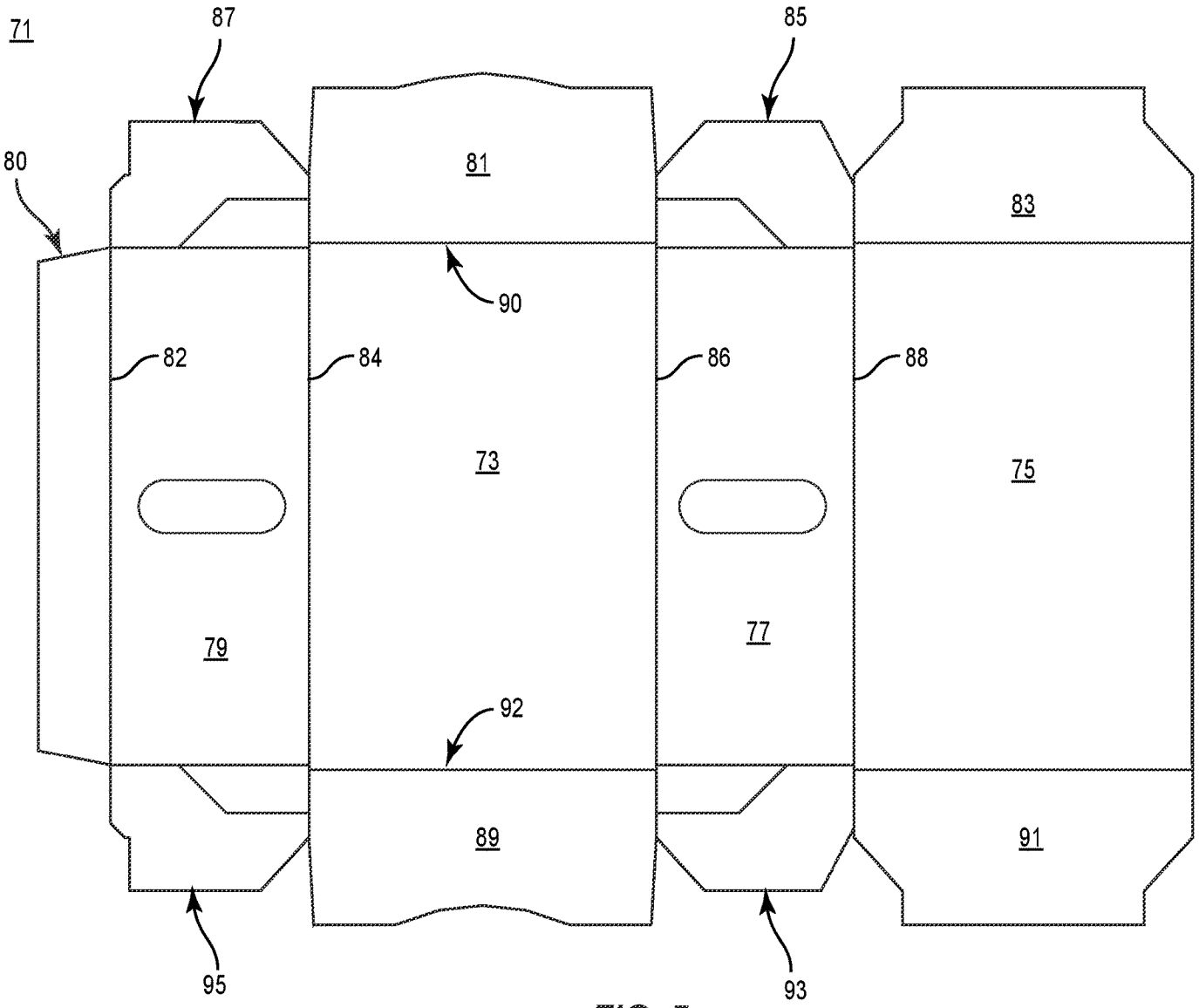
FIG. 5 is a plan schematic view of a blank for forming a product holding container for use with various embodiments of the disclosure.

In the illustrated embodiment, the product holding containers C are illustrated as paperboard cartons formed by the carton blank 71 (FIG. 5) that hold a consumer product (e.g., soap or other personal care or consumer products). As shown in FIG. 5, the carton blank 71 can have a top panel 73, a bottom panel 75, two side panels 77, 79, and an attachment flap 80. The carton blank 71 can also include end flaps 81, 83, 85, 87 for closing a first end of the containers C and second end flaps 89, 91, 93, 95 for closing a second end of the containers C. In the illustrated arrangement, the attachment flap 80, side panel 79, top panel 73, side panel 77, and bottom panel 75 can be foldably connected at respective lateral fold lines 82, 84, 86, 88, the end flaps 81, 83, 85, 87 can be foldably connected to respective panels of the plurality of panels of the carton blank 71 at respective portions of a longitudinal fold line 90, and the end flaps 89, 91, 93, 95 can be foldably connected to respective panels of the plurality of panels of the carton blank 71 at respective portions of a longitudinal fold line 92. Other containers may be held in the shipping and dispensing construct 105, and/or the containers C can have a different configuration, without departing from the disclosure.

Still referring to FIG. 1, the construct blank 103 has a longitudinal axis L1 and a lateral axis L2. In the illustrated embodiment, the construct blank 103 has a front panel 131 foldably connected to a bottom panel 133 at a lateral fold line 135, a first side panel 137 separably/foldably connected to the front panel 131 at a longitudinal tear line 139, and a second side panel 141 separably/foldably connected to the front panel 131 at a longitudinal tear line 143.

As also shown, the front panel 131 is separably/foldably connected to a first securing panel 145 at a lateral tear line 147. The securing panel 145 is separably/foldably connected to a first central panel 149 at a longitudinal tear line 151, and a second central panel 153 is separably/foldably connected to the first central panel 145 at a longitudinal tear line 155.

A second securing panel 157, as shown, is separably/foldably connected to the second central panel 153 at a longitudinal tear line 159.

As also shown, the first central panel 149 is separated from the front panel 131 at a portion of a lateral cut 161 that is collinear with the lateral fold line 147, the second central panel 153 is separated from respective portions of the front panel 131 and the bottom panel 141 at respective portions of the cut 161, and the second securing panel 157 is separated from the side panel 141 at a respective portion of the cut 161.

The construct blank 103 can also include a plurality of end flaps separably/foldably connected to respective panels, and as shown, can include a first side end flap 163 separably/foldably connected to the side panel 137 at a lateral tear line 165 and separated from the bottom panel 133 at a longitudinal cut 167, a second side end flap 169 separably/foldably connected to the side panel 141 at a lateral tear line 171 and separated from the bottom panel 133 at a longitudinal cut 173, and a central end flap 175 separably/foldably connected to the central panel 153 at a lateral tear line 177.

With continued reference to FIG. 1, the side panels 137, 141 can each include dispensing/separating features in the form of attachment tabs 179 that are for receiving glue or other suitable adhesive to attach a respective container C to the shipping and dispensing construct 105.

As shown, each attachment tab 179 can be formed by a generally circular cut 181 such that the attachment tabs 179 are separably connected to the respective panels 137, 141. In one embodiment, one or more lines of weakening, e.g., nicks, creases, etc., can be provided intersecting the respective cuts 181 to facilitate connection and/or separation of the attachment tabs 179 to the respective panels 137, 141.

As also shown, each of the side panels 137, 141 can include a respective plurality of panel sections 183 (broadly, "first side dispensing portions" and "second side dispensing portions", respectively), each panel section 183 separably/foldably connected to an adjacent panel section 183 at a respective lateral tear line 184, and each panel section 183 foldably/separably connected to the front panel 131 at a respective portion of the tear line 139.

Similarly, each central panel 149, 153 can have dispensing/separating features including a respective plurality of panel sections 185 (broadly, "first central dispensing portions" and "second central dispensing portions", respectively), each adjacent panel section 185 separable from each other at a respective lateral tear line 187, and each panel section 185 separable from the respective securing panel 145, 157 at a portion of a respective tear line 151, 159.

While each panel section 183, 185 is shown formed around an attachment tab 179 such that each of the top panel 137 and the bottom panel 141 include a row of six separable panel sections 183 including respective attachment tabs 179 and such that each central panel 149, 153 includes a row of six separable panel sections 185 including respective attachment tabs 179, it will be understood that the attachment tabs 179 and panels sections 183, 185 can be otherwise shaped, arranged, and/or formed by other lines of weakening without departing from the disclosure.

Figure 2:
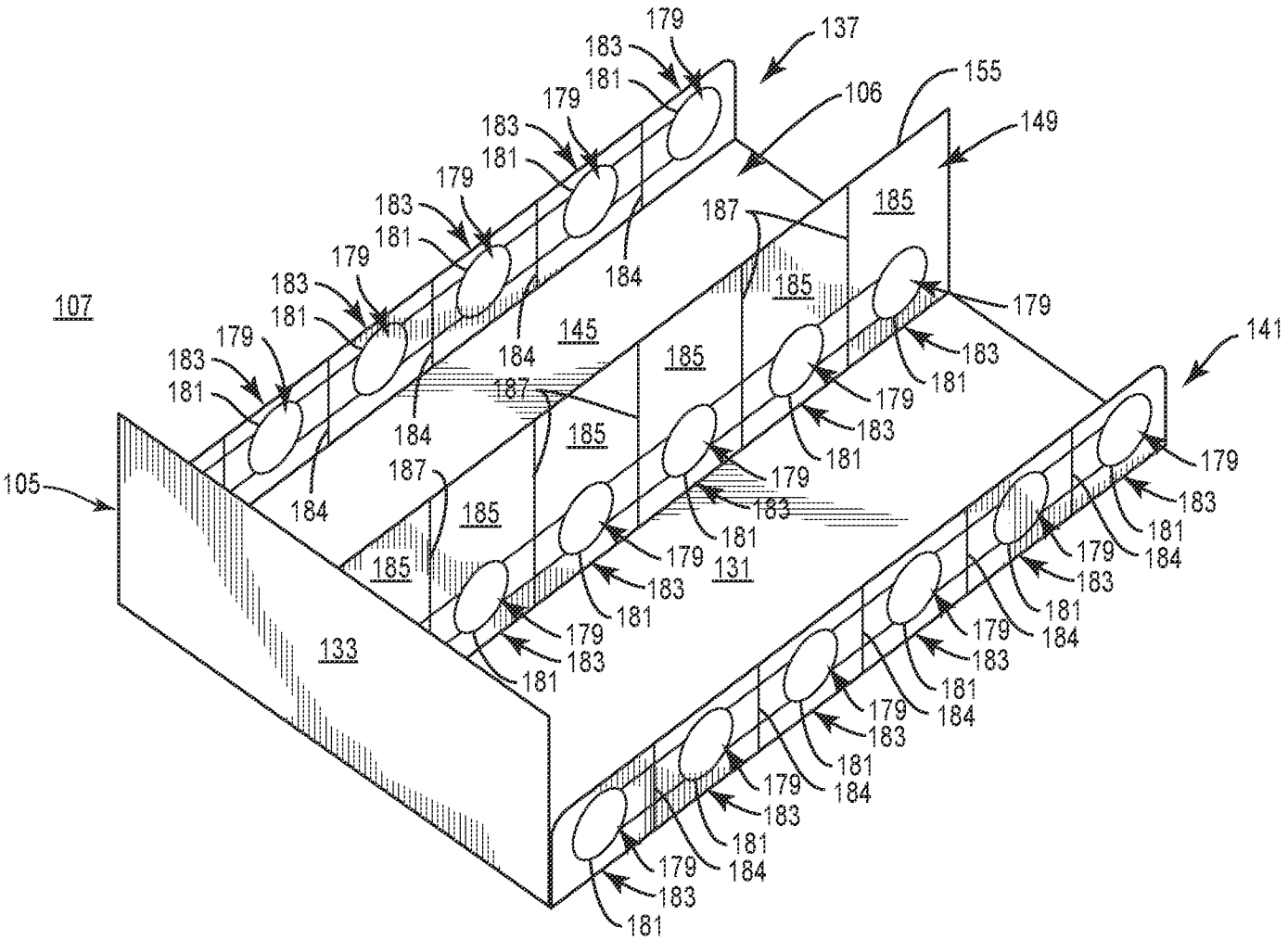
FIG. 2 is a perspective view of a shipping and dispensing construct formed from the blank of FIG. 1 according to the first exemplary embodiment of the disclosure.

With additional reference to FIG. 2, according to one exemplary embodiment of the disclosure, the shipping and dispensing construct 105 can be formed from the construct blank 103 by folding the securing panel 145 at the fold line 147 such that the securing panel 145 is positioned in at least partial face-to-face contact with a respective portion of the front panel 131 and such that the central panel 149 and a portion of the central panel 153 are carried into at least partial face-to-face contact with respective portions of the front panel 131 and the side panel 141.

Thereafter, the second central panel 153 can be folded at the tear line 155 such that the first central panel 149 and the second central panel 153 are positioned in at least partial face-to-face contact, and such that the securing panel 157 is positioned in at least partial face-to-face contact with the securing panel 145.

The overlapped central panels 149, 153 can together be folded at the overlapped tear lines 151, 159 such that the central panels 149, 153 are positioned in generally upright and perpendicular relation with the front panel 131. In such an arrangement, the plurality of panels of the shipping and dispensing construct 105 extends at least partially around an interior 106 thereof.

Figure 3:
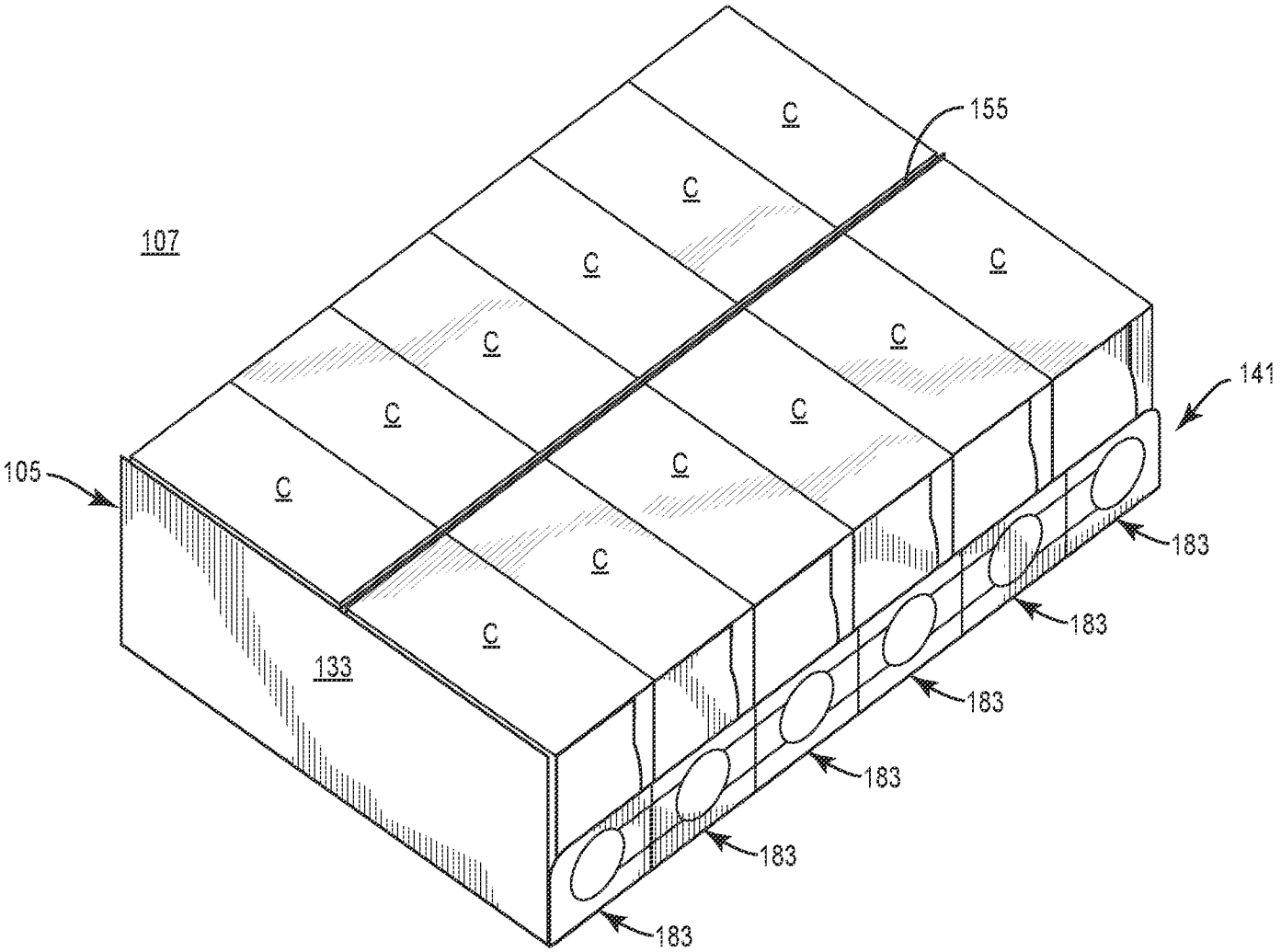
FIG. 3 is a perspective view of the shipping and dispensing construct of FIG. 2 further holding a plurality of product containers.

With additional reference to FIG. 3, two rows of the product holding containers C can be positioned on either side of the central panels 149, 153. Glue or other adhesive can be applied to the attachment tabs 179 such that the containers C are adhered to the attachment tabs 179 of the respective central panels 149, 153, and the side panels 137, 141 can be folded at the respective tear lines 139, 143 so that the containers C are adhered to the attachment tabs 179 of the respective panels 137, 141. Such adhesive can be applied to the construct blank 103 prior to the attachment of respective containers C, or the glue or other adhesive can be applied to a respective container C prior to attachment to the blank 103 without departing from the disclosure.

Simultaneously or thereafter, the bottom panel 133 can be folded at the fold line 135, the end flaps 163, 169 can be folded at the respective fold lines 165, 171 into at least partial face-to-face contact with the bottom panel 133, and the end flap 175 can be folded at the tear line 177 into at least partial face-to-face contact with the bottom panel 133.

In view of the foregoing, the shipping and dispensing construct 105 at least partially extends around the two rows of product holding containers C, and package 107 of the present disclosure can be formed by providing the shipping dispensing construct 105 with one or more of the product holding containers C attached to the construct 105. The package 107 can thus be shipped to a point of sale vendor (e.g., department store, grocery store, etc.) for sale to a consumer. The package 107, shipping dispensing construct 105, and/or construct blank 103 can have other features and can be alternatively shaped, arranged, and/or configured without departing from the disclosure.

Figure 4:
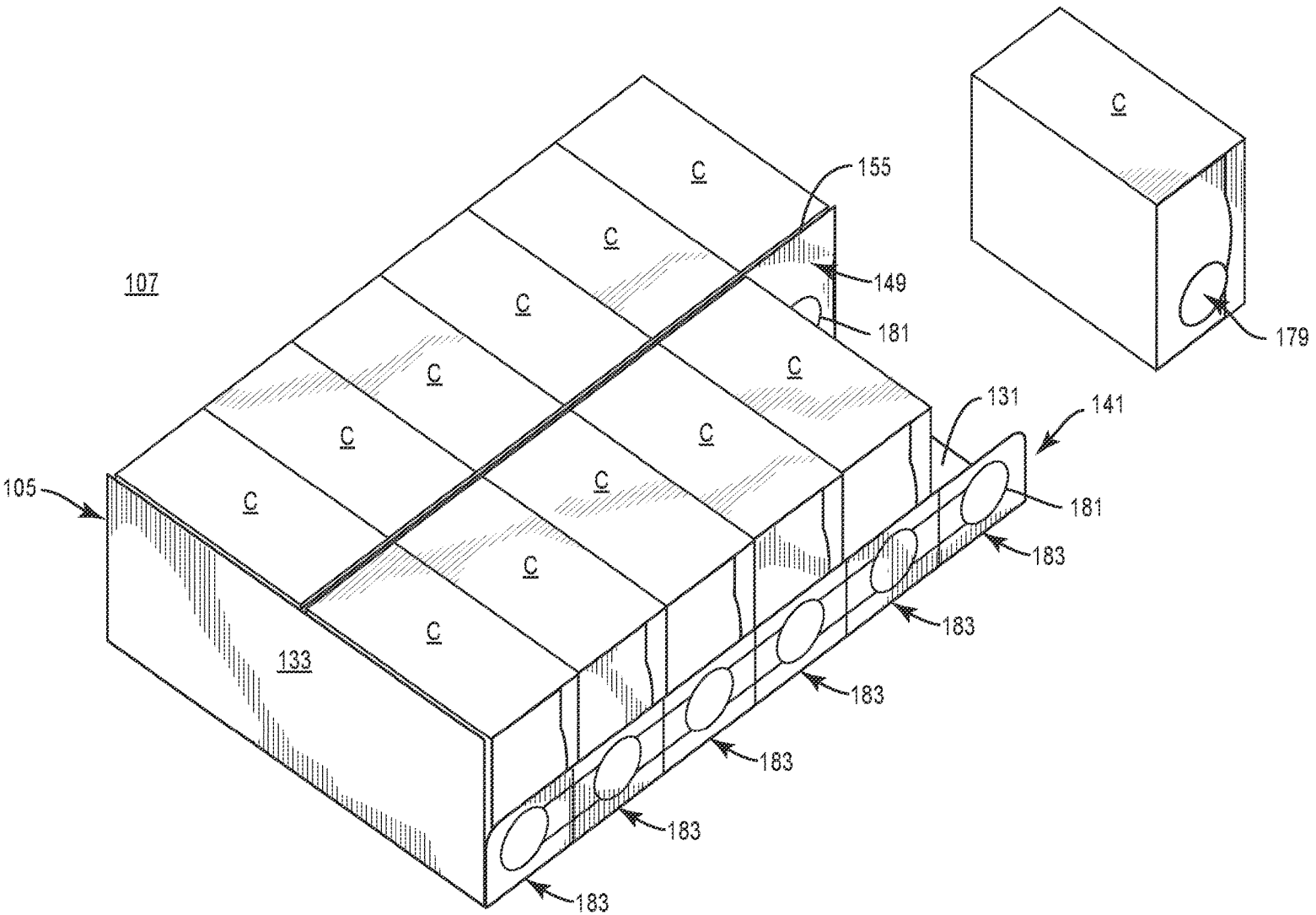
FIG. 4 is a perspective view of the shipping and dispensing construct as shown in FIG. 3, and having one or more of the product containers removed therefrom.

In one embodiment, and with additional reference to FIG. 4, the product holding containers C can be dispensed/removed from the shipping and dispensing construct 105 of the package 107 by pulling the respective container C away from a respective side panel 137, 141 to cause a respective attachment tabs 179 to separate from the respective panels 137, 141 at the respective cuts 181. Such action can result in the respective attachment tab 179 remaining attached to a respective product holding container C after separation from the respective side panel 137, 141.

When the attachment tabs 179 separate from the respective panels 137, 141 the product holding containers C are free to be dispensed or removed from the shipping and dispensing construct 105 by further separating the attachment tabs 179 from the respective central panels 149, 153 at the respective cuts 181.

In one embodiment, one or both of the central panels 149, 153 can be separated from the respective securing panel 145, 157 at the respective tear lines 151, 159, and can be separated from each other at the tear line 155 such that an entire row of product holding containers C can be separated/ removed from the construct 105 together with the respective central panel 149, 153. Such removal of an entire row of product holding containers C can also include the separation of a respective side panel 137, 141 from the front panel 131 at a respective tear lines 139, 143.

In another embodiment, one or more of the panel sections 183 of the side panels 137, 141 and/or one of the panel sections 185 of the central panels 149, 153 can be selectively removed at respective adjacent tear lines 184, 187 to provide for access and selective removal of product holding containers C from the construct 105 in a modular fashion.

Accordingly, one or more of the side panels 137, 139, the central panels 149, 153, and the respective associated panel sections 183, 185 can form dispensing features or dispensing portions of the package 107/construct 105.

In view of the foregoing, the disclosed package 107/shipping and dispensing construct 105 provides for selective and modular or bulk dispensing of product holding containers therefrom in an arrangement that is versatile, robust due to multiple points of attachment, and provides ready visibility of the containers C to a consumer. In addition, the front panel 131 can provide a suitable surface for printed indicia, for example, product, pricing, or advertising information.

Figure 6:
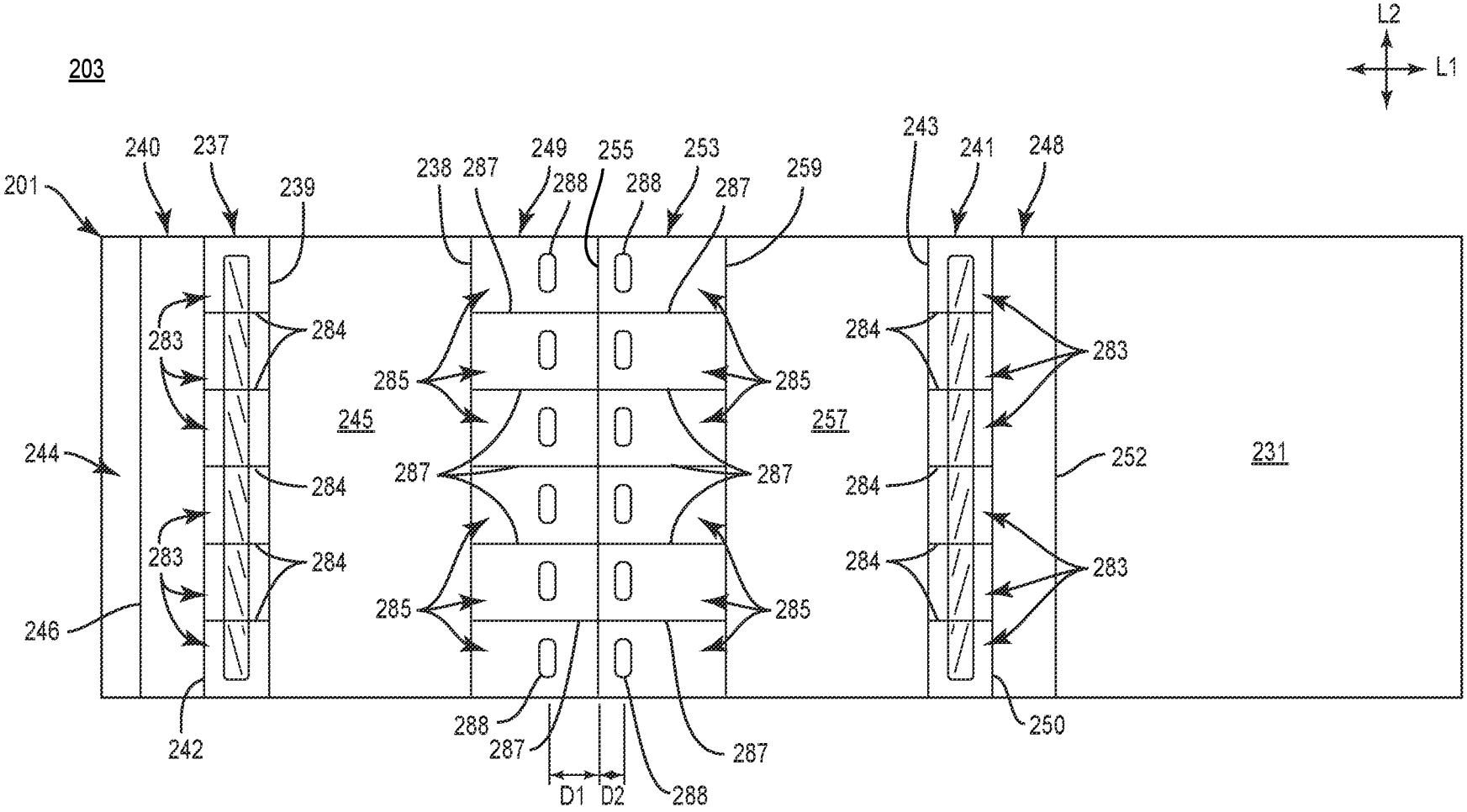
FIG. 6 is a plan schematic view of a construct blank for forming a shipping and dispensing construct according to a second exemplary embodiment of the disclosure.

Turning to FIG. 6, an exterior surface 201 of a construct blank 203 for forming a shipping and dispensing construct 205 (FIG. 7) according to a second exemplary embodiment of the disclosure is illustrated. The construct blank 203 and the shipping and dispensing construct 205 formed therefrom can have one or more features that are the same or similar to those of the construct blank 103 and the shipping and dispensing construct 105 of the first exemplary embodiment, and like or similar reference numerals are provided for like or similar features.

The construct blank 203 has the longitudinal axis L1 and the lateral axis L2. As shown, the construct blank 203 can include a first central panel 249 separably/foldably connected to a second central panel 253 at a lateral tear line 255, a first securing panel 245 foldably/separably connected to the first central panel 249 at a lateral tear line 238, and a second securing panel 257 separably/foldably connected to the second central panel 253 at a lateral tear line 259.

In the illustrated embodiment, a first side panel 237 can be separably/foldably connected to the first securing panel 245 at a lateral tear line 239, a first side extension panel 240 can be foldably connected to the first side panel 237 at a lateral fold line 242, and an attachment flap 244 can be foldably connected to the extension panel 240 at a lateral fold line 246.

Similarly, a second side panel 241 can be separably/foldably connected to the second securing panel 257 at a lateral tear line 243, a second side extension panel 248 can be foldably connected to the second side panel 241 at a lateral fold line 250, and a front panel 231 can be foldably connected to the extension panel 248 at a lateral fold line 252.

With continued reference to FIG. 6, the side panels 237, 241 can each include dispensing/separating features in the form of separable panel sections 283 (broadly, "first side dispensing portions" and "second side dispensing portions", respectively), that are for receiving glue or other suitable adhesive to attach a respective container C to the shipping and dispensing construct 205. Each panel section 283, as shown, is separably connected to an adjacent panel section 283 at a longitudinal tear line 284 such that each panel section is foldably connected to a respective side extension panel 240, 248 at a portion of a respective fold line 242, 250, and such that each panel section 283 is separably connected to a respective securing panel 245, 257 at a portion of a respective tear line 239, 243. In some embodiments, one or both of the side panels 237, 241 can be provided with surface features, e.g., lines of weakening/hatching, embossing/debossing, etc. to facilitate attachment to one or more containers of the product holding containers C, e.g., with an adhesive such as glue.

Similarly, each central panel 249, 253 can have dispensing/separating features including a respective plurality of panel sections 285 (broadly, "first central dispensing portions" and "second central dispensing portions", respectively), each adjacent panel section 285 separable from each other at a respective lateral tear line 287, and each panel section 285 separable from the respective securing panel 245, 257 at a portion of a respective tear line 238, 259.

As also shown, each panel section 285 of the central panels 249, 253 can include a glue opening 288 defined therein. In the illustrated embodiment, the glue openings 288 in the central panel 249 can be generally uniformly spaced a longitudinal distance D1 (broadly, "first distance") from the tear line 255, and the glue openings 288 in the central panel 253 can be generally uniformly spaced a longitudinal distance D2 (broadly, "second distance") from the tear line 255, with the distance D1 being greater than the distance D2. As described further below, the arrangement of glue openings 288 across the central panels 253 can facilitate attachment of the product holding containers C to the construct 205.

It will be understood that the panels sections 283, 285 can be otherwise shaped, arranged, and/or formed by other lines of weakening without departing from the disclosure.

Figure 7:
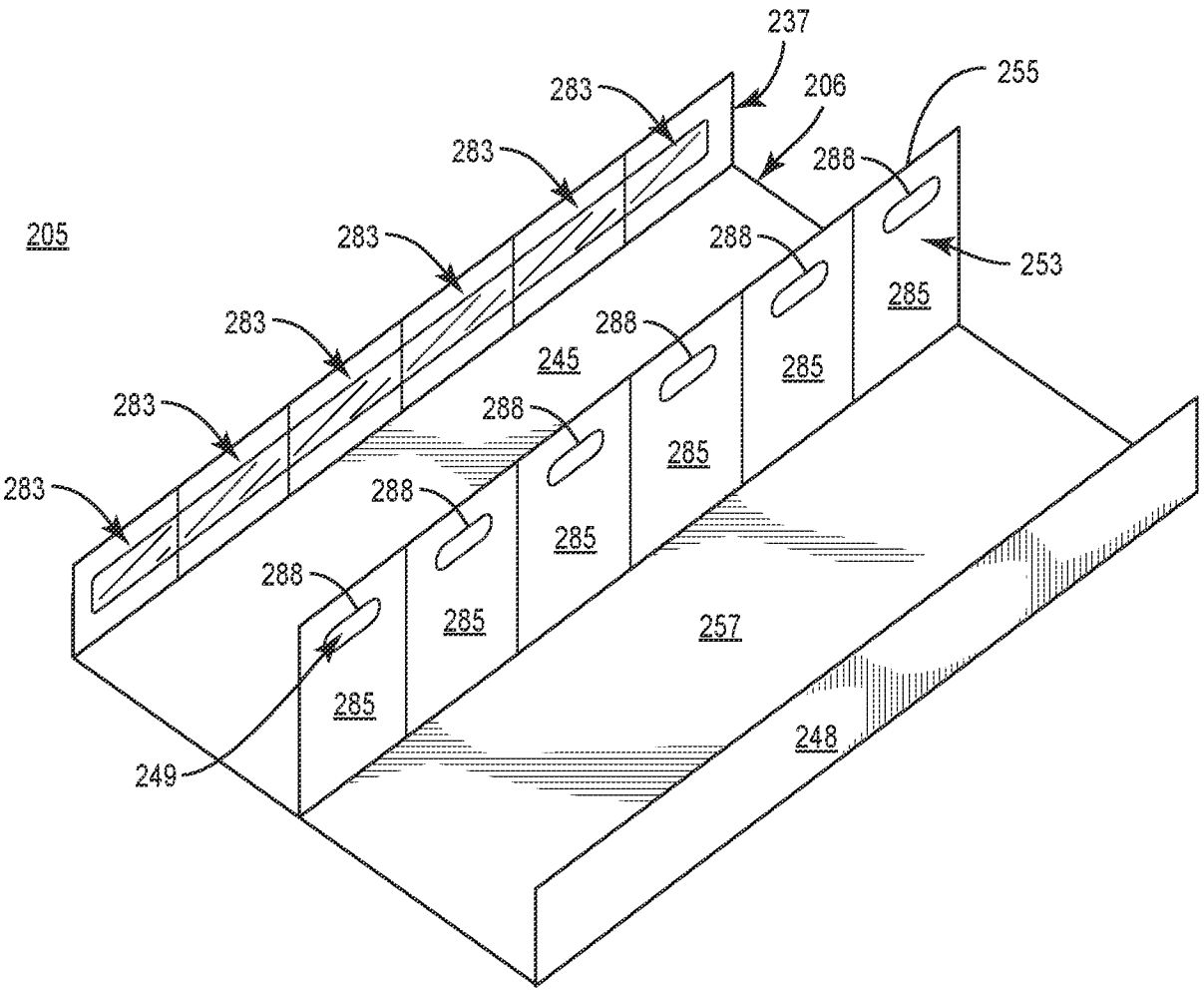
FIG. 7 is a perspective view of a shipping and dispensing construct formed from the blank of FIG. 6 according to the second exemplary embodiment of the disclosure.
Figure 8:
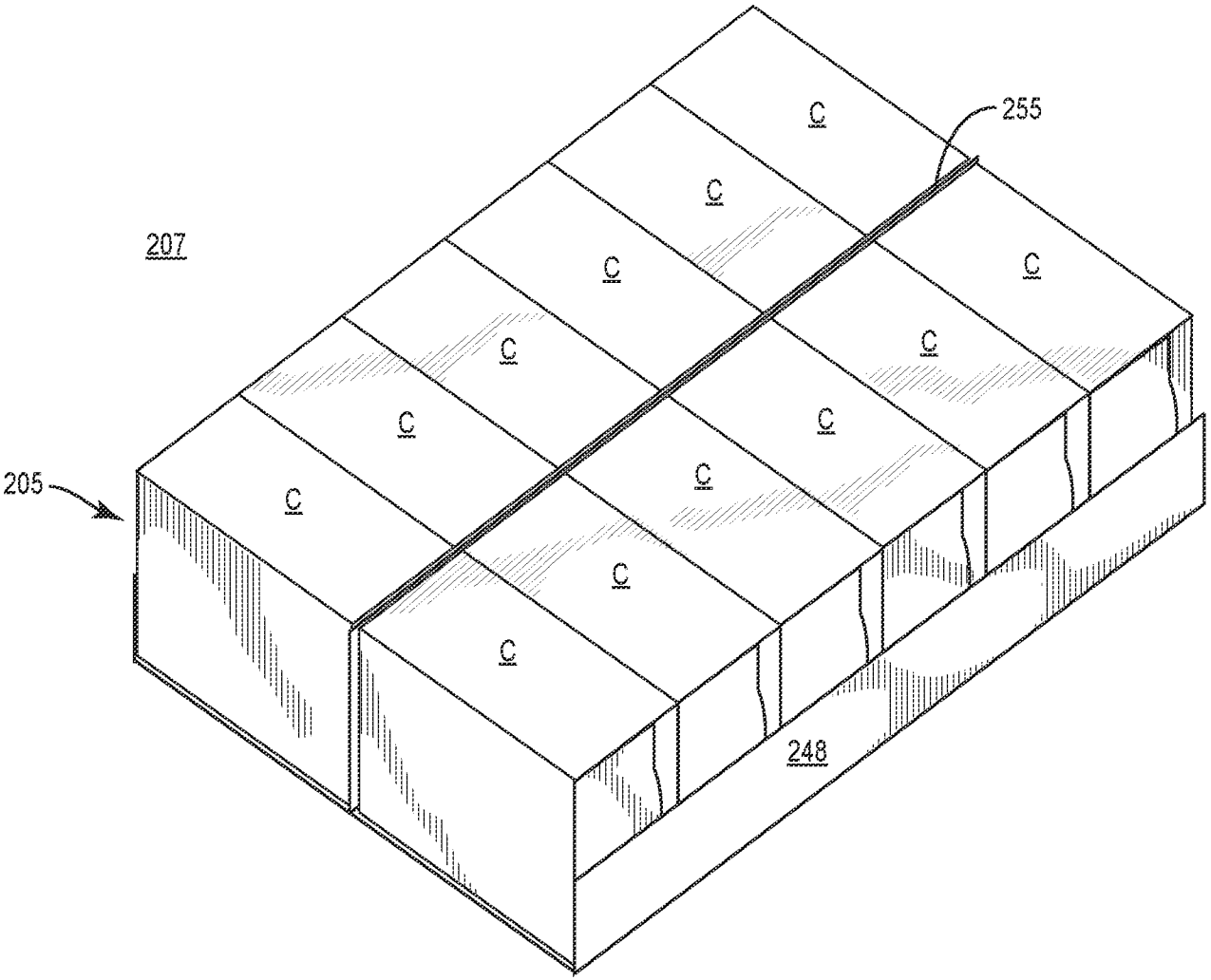
FIG. 8 is a perspective view of the shipping and dispensing construct of FIG. 7 further holding a plurality of product containers.

With reference to FIGS. 7 and 8, formation of the shipping and dispensing construct 205 from the construct blank 203 is shown according to one exemplary embodiment of the disclosure.

In the illustrated embodiment, the construct blank 203 can be positioned with the exterior surface 201 thereof facing downwardly and the central panels 249, 253 can be folded at the respective fold lines 238, 259 and at the fold line 255 into at least partial face-to-face contact with one another.

In such an arrangement, the glue openings 288 of the central panel 249 can be positioned to be offset from the glue openings 288 of the central panel 253, e.g., due to the relatively different distances thereof from the tear line 255. In this regard, respective portions of the central panel 253 can be exposed through the glue openings 288 of the central panel 249, and respective portions of the central panel 249 can be exposed through the glue openings 288 of the central panel 253. Such exposed surfaces of the central panels 249, 253 through the respective glue openings 288 can provide surfaces for attachment, e.g., with and adhesive such as glue, for respective product holding containers C to the respective central panels 249, 253.

It will be understood that the central panels 249, 253 and/or glue openings 288 can have a different arrangement without departing from the disclosure. For example, the glue openings 288 of the central panel 249 and the glue openings 288 of the central panel 253 could be spaced uniform longitudinal distances from the tear line 255 so as to be aligned upon formation of the construct 205. In such an arrangement, communication between product holding containers C adjacent the central panel 249 and product holding containers C adjacent the central panel 253 could be provided through the aligned glue openings 288, e.g., to permit attachment of product holding containers C therethrough.

The side panels 237, 241 can be folded at the respective fold lines 239, 243, the side extension panel 240 can be folded at the fold line 242 into at least partial face-to-face contact with the side panel 237, and the side extension panel 248 can be folded at the fold line 250 into at least partial face-to-face contact with the side panel 241. Further, the front panel 231 can be folded at the fold line 252 into at overlapping face-to-face contact with respective portions of the securing panels 245, 257. In order to maintain such an arrangement, the attachment flap 244 can be folded at the fold line 246 and positioned in at least partial face-to-face contact with the front panel 231.

Accordingly, the shipping and dispensing construct 205 at least partially extends around an interior 206 thereof for holding rows of product holding containers C, and a package 207 of the present disclosure can be formed by providing the shipping dispensing construct 205 with one or more of the product holding containers C attached to the construct 205 for shipping to a point of sale vendor and/or for dispensing/sale to a consumer. The package 207 is provided with additional reinforcement and integrity due to the attachment of longitudinally adjacent product holding containers C through the aligned glue openings 288 of the central panels 249, 253.

The package 207, shipping and dispensing construct 205, and/or construct blank 203 can have other features and can be alternatively shaped, arranged, and/or configured without departing from the disclosure.

Figure 9:
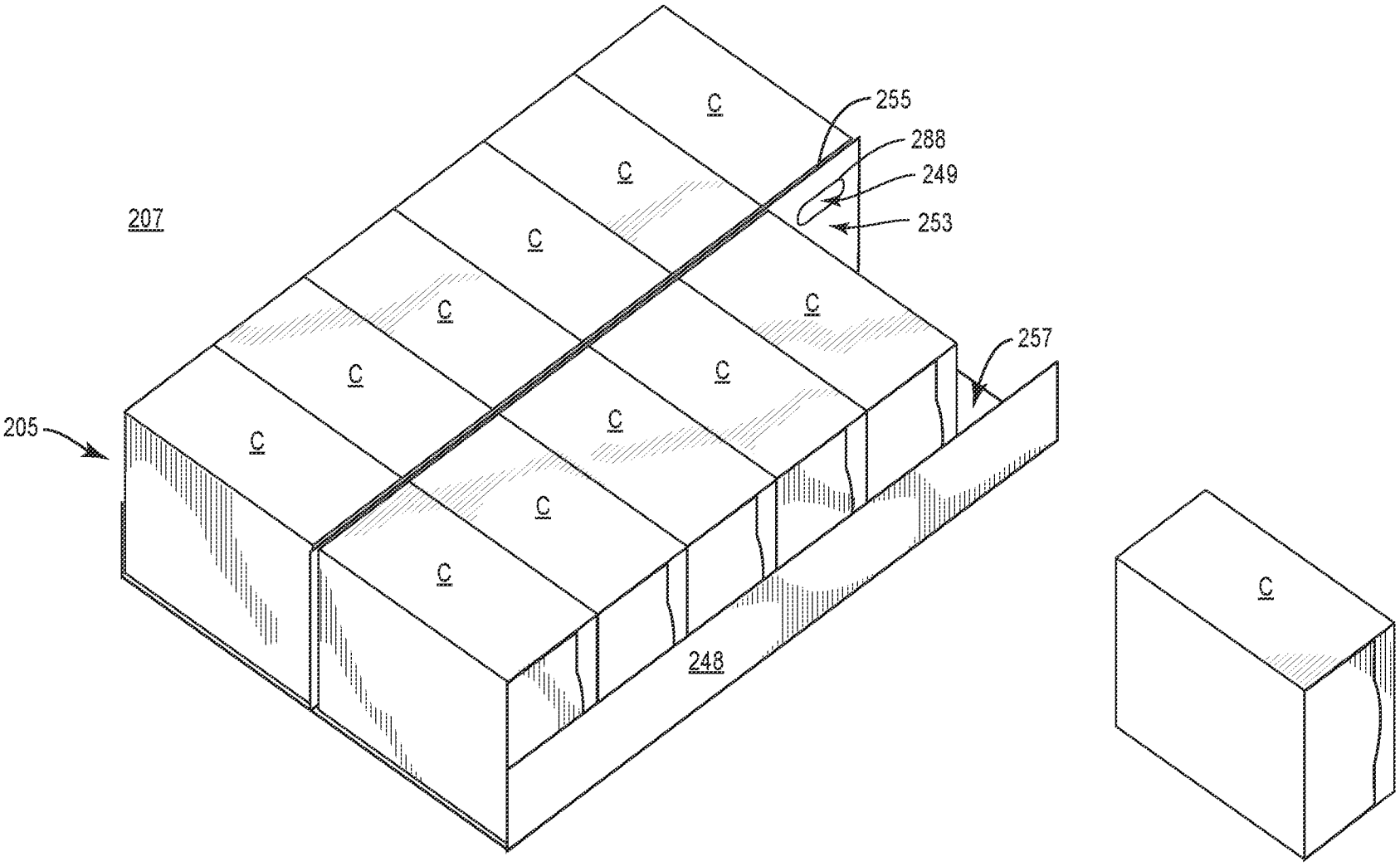
FIG. 9 is a perspective view of the shipping and dispensing as shown in FIG. 8, and having one or more of the product containers removed therefrom.

With additional reference to FIG. 9, in one embodiment, the product holding containers C can be dispensed from the shipping and dispensing construct 205 of the package 207 by tearing one or both of the side panels 237, 241 at the respective tear lines 239, 243 to expose or access the product holding containers C attached thereto. The product holding containers C are thus free to be dispensed or removed from the shipping and dispensing construct 205 by further separating the containers C from the respective central panels 249, 253 and/or central panels 249, 253 to which they are attached through the respective glue openings 288.

In one embodiment, one or both of the central panels 249, 253 can be separated from the respective securing panel 245, 257 at the respective tear lines 238, 259, and can be separated from each other at the tear line 255 such that an entire row of product holding containers C can be separated from the construct 205 together with the respective central panel 249, 253.

In another embodiment, one or more of the panel sections 283, 285 can be selectively removed at adjacent tear lines to provide for access and selective removal of product holding containers C from the construct 205 in a modular fashion.

Accordingly, one or more of the side panels 237, 241, the central panels 139, 153, and the respective associated panel sections 183, 185 can form dispensing features/portions of the package 107/construct 105.

In view of the foregoing, the disclosed package 207/shipping and dispensing construct 205 provides for selective and modular or bulk dispensing/removal of product holding containers therefrom in an arrangement that is versatile, robust due to multiple points of attachment, and provides ready visibility of the containers C to a consumer. In addition, the front panel 231 can provide a suitable surface for printed indicia, for example, product, pricing, or advertising information.

Figure 10:
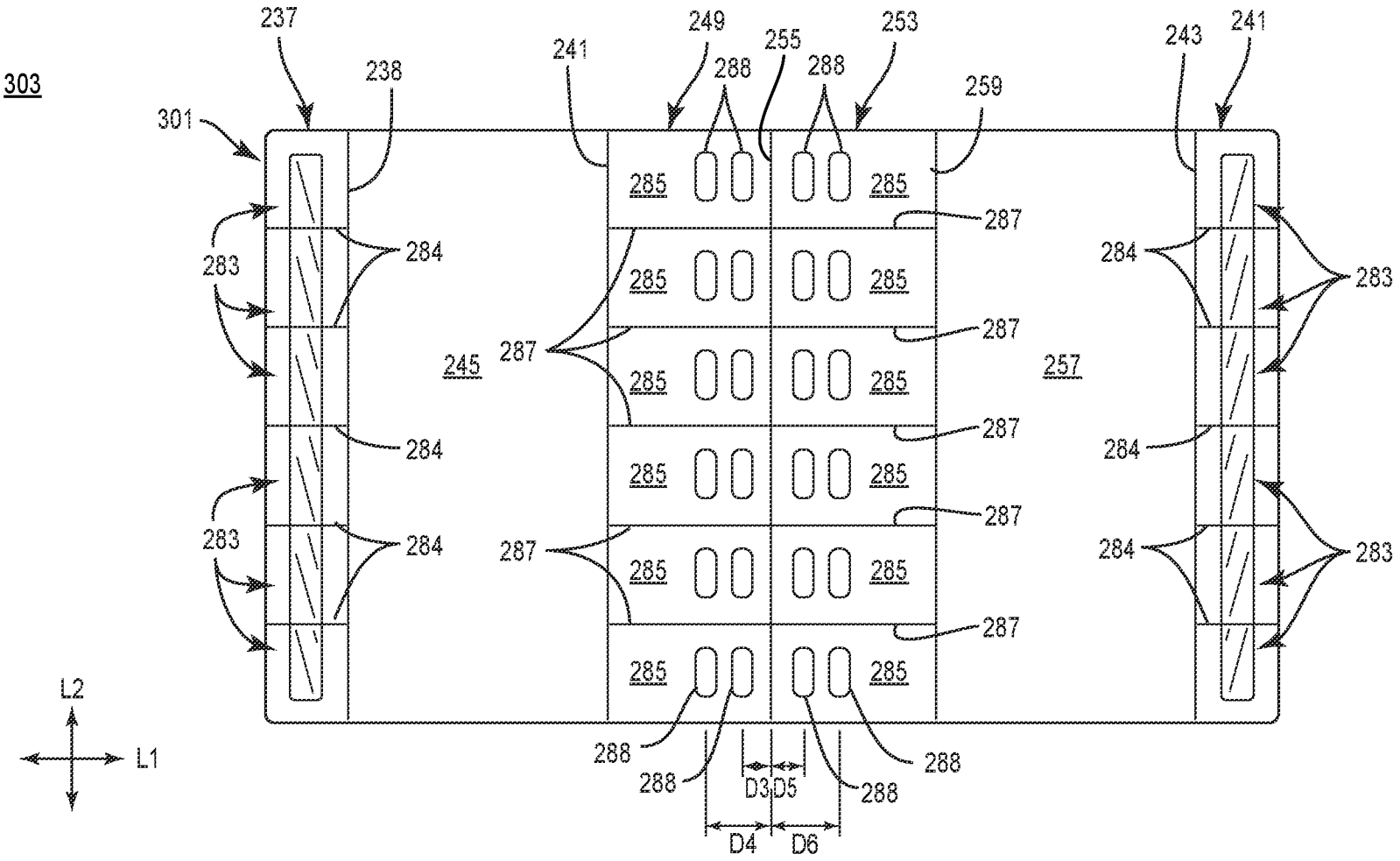
FIG. 10 is a plan schematic view of a construct blank for forming a shipping and dispensing construct according to a third exemplary embodiment of the disclosure.

Turning to FIG. 10, an exterior surface 301 of a construct blank 303 for forming a shipping and dispensing construct 305 according to a third exemplary embodiment of the disclosure is illustrated. The construct blank 303 and the shipping and dispensing construct 305 formed therefrom can have one or more features that are the same or similar to those of the construct blank 103 and the shipping and dispensing construct 105 of the first exemplary embodiment and the construct blank 203 and the shipping and dispensing construct 205 of the second exemplary embodiment, and like or similar reference numerals are provided for like or similar features.

As shown, the construct blank 303 has features similar to those of the construct blank 203 described above, with the exception that the construct blank 303 is devoid of the extension panels 240, 248, the front panel 231, and the attachment flap 244.

In addition, the central panel 249 of the blank 303 can include a first row of glue openings 288 generally uniformly longitudinally spaced a distance D3 (broadly, "first distance") from the tear line 255, and a second row of glue openings 288 generally uniformly longitudinally spaced a distance D4 (broadly, "second distance") from the tear line 255, the distance D4 greater than the distance D3. Similarly, the central panel 253 of the construct blank 303 can include a first row of glue openings 288 generally uniformly longitudinally spaced a distance D5 (broadly, "first distance") from the tear line 255, and a second row of glue openings 288 generally uniformly longitudinally spaced a distance D6 (broadly, "second distance") from the tear line 255, the distance D6 greater than the distance D5. As described further below, the arrangement of glue openings 288 across the central panels 253 can facilitate attachment of the product holding containers C to the construct 305.

Figure 11:
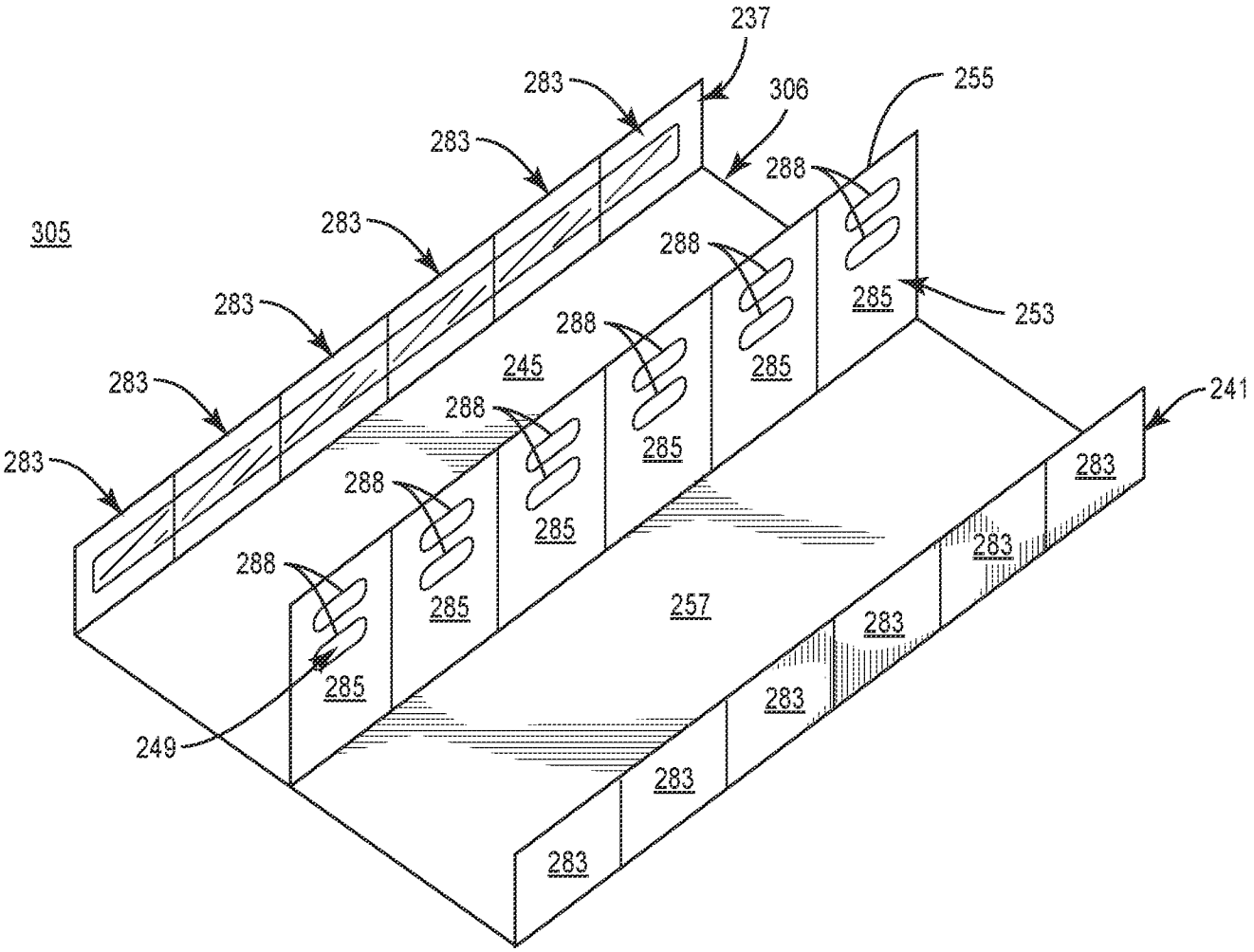
FIG. 11 is a perspective view of a shipping and dispensing construct formed from the blank of FIG. 10 according to the third exemplary embodiment of the disclosure.

In this regard, and with additional reference to FIG. 11, the shipping and dispensing construct 305 can be formed from the construct blank 303 in a manner similar to that described above with regard to the formation of the shipping and dispensing construct 205 from the construct blank 203, without the associated folding and arranging the extension panels 240, 248, the front panel 231, and the attachment flap 244.

Figure 12:
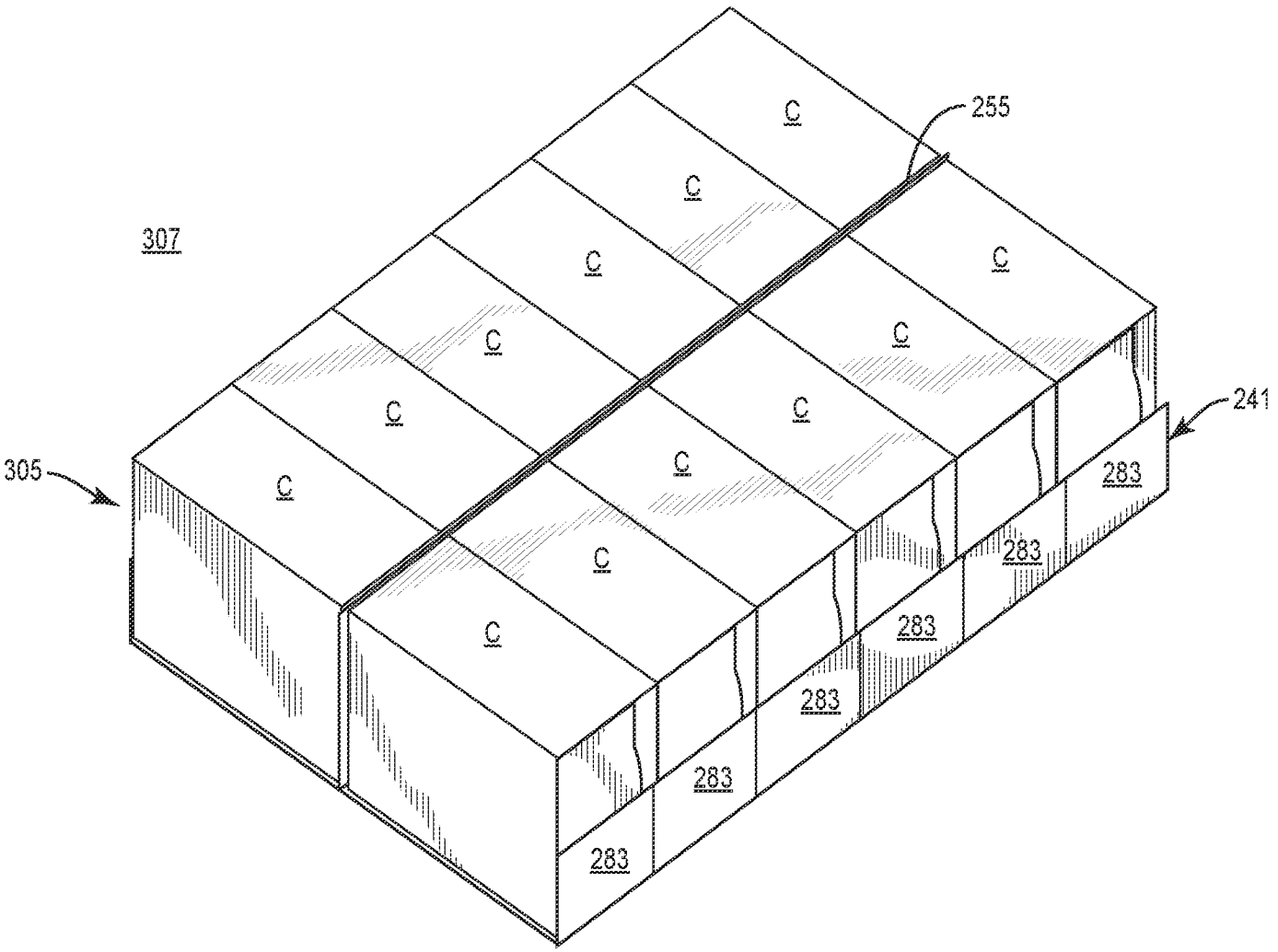
FIG. 12 is a perspective view of the shipping and dispensing construct of FIG. 11 further holding a plurality of product containers.

Accordingly, and with additional reference to FIG. 12, the shipping and dispensing construct 305 can be formed so as at least partially extend around an interior 306 thereof for holding the two rows of product holding containers C, and a package 307 of the present disclosure can be formed by providing the shipping dispensing construct 305 with one or more of the product holding containers C attached to the construct 305 for shipping to a point of sale vendor and/or for sale to a consumer.

In view of the lack of a front panel overlying the securing panels 245, 257 of the shipping and dispensing construct as in the first embodiment and the second embodiment, the securing panels 245, 257 can be considered front panels of the construct 305. In one embodiment, a label panel or secondary panel can be provided in at least partial face-to-face contact with a respective portion of the securing panels 245, 257 so as to span across a discontinuity therebetween formed by the presence of the central panels 249, 253. Such label panel can be provided, for example, to facilitate in maintaining the integrity of the shipping and dispensing construct 305 and/or to provide a surface suitable for receiving printed indicia, for example, product, pricing, or advertising information. A label panel can also facilitate printing on the securing panels 245, 257 for additional product, priding, or advertising information in the form of coupons, incentives or giveaways associated with social media, etc. In one embodiment, the shipping and dispensing construct 305 can be devoid of a label panel.

Figure 13:
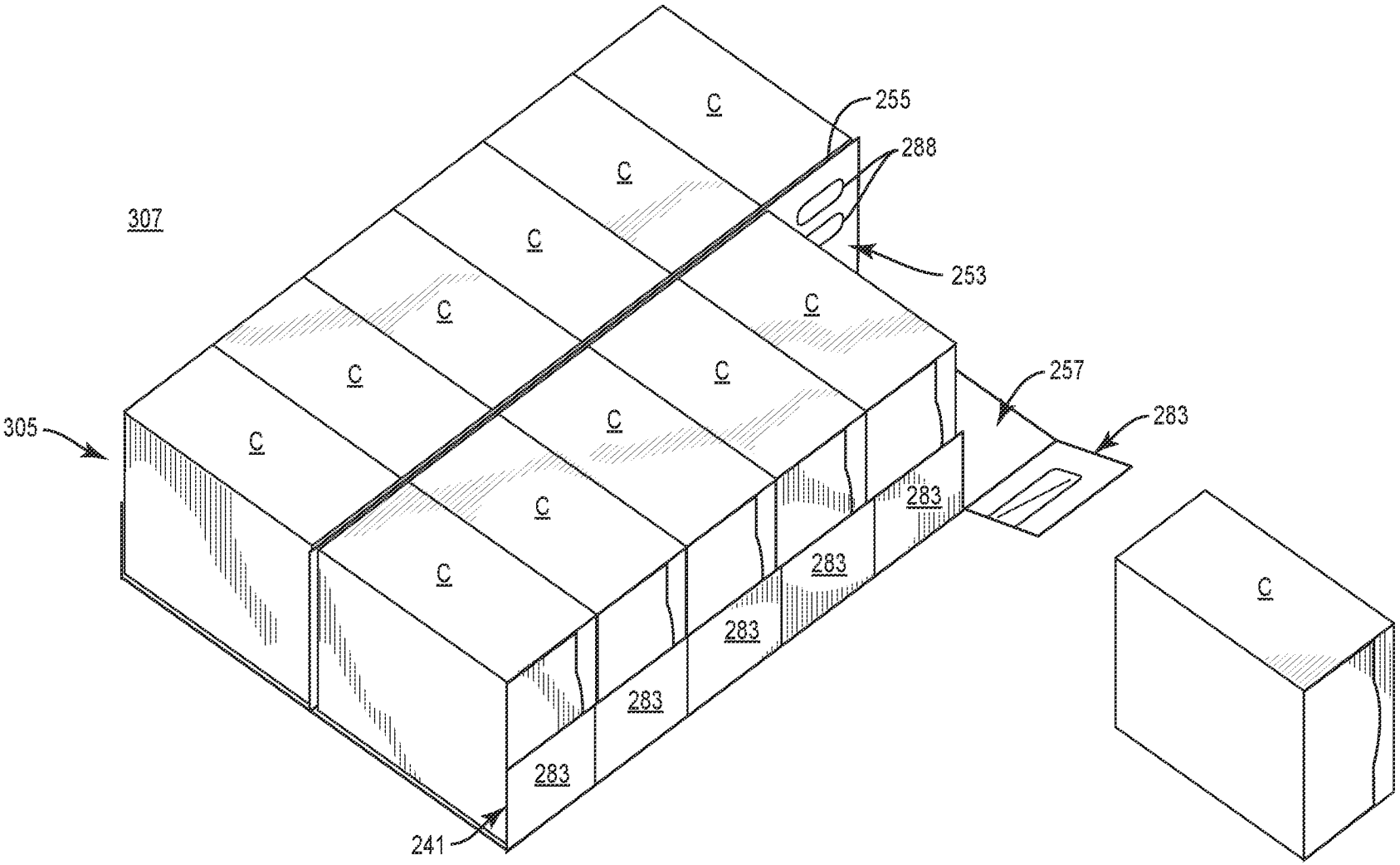
FIG. 13 is a perspective view of the shipping and dispensing construct as shown in FIG. 12, and having one or more of the product containers removed therefrom.

In this regard, and with additional reference to FIG. 13, the disclosed package 307/shipping and dispensing construct 305 provides for selective and modular or bulk dispensing/removal of product holding container in a manner similar to that described above with regard to the package 107/construct 207 and the package 207/construct 205, and with similar advantages.

The package 307, shipping and dispensing construct 305, and/or construct blank 303 can have other features and can be alternatively shaped, arranged, and/or configured without departing from the disclosure.

Figure 14:
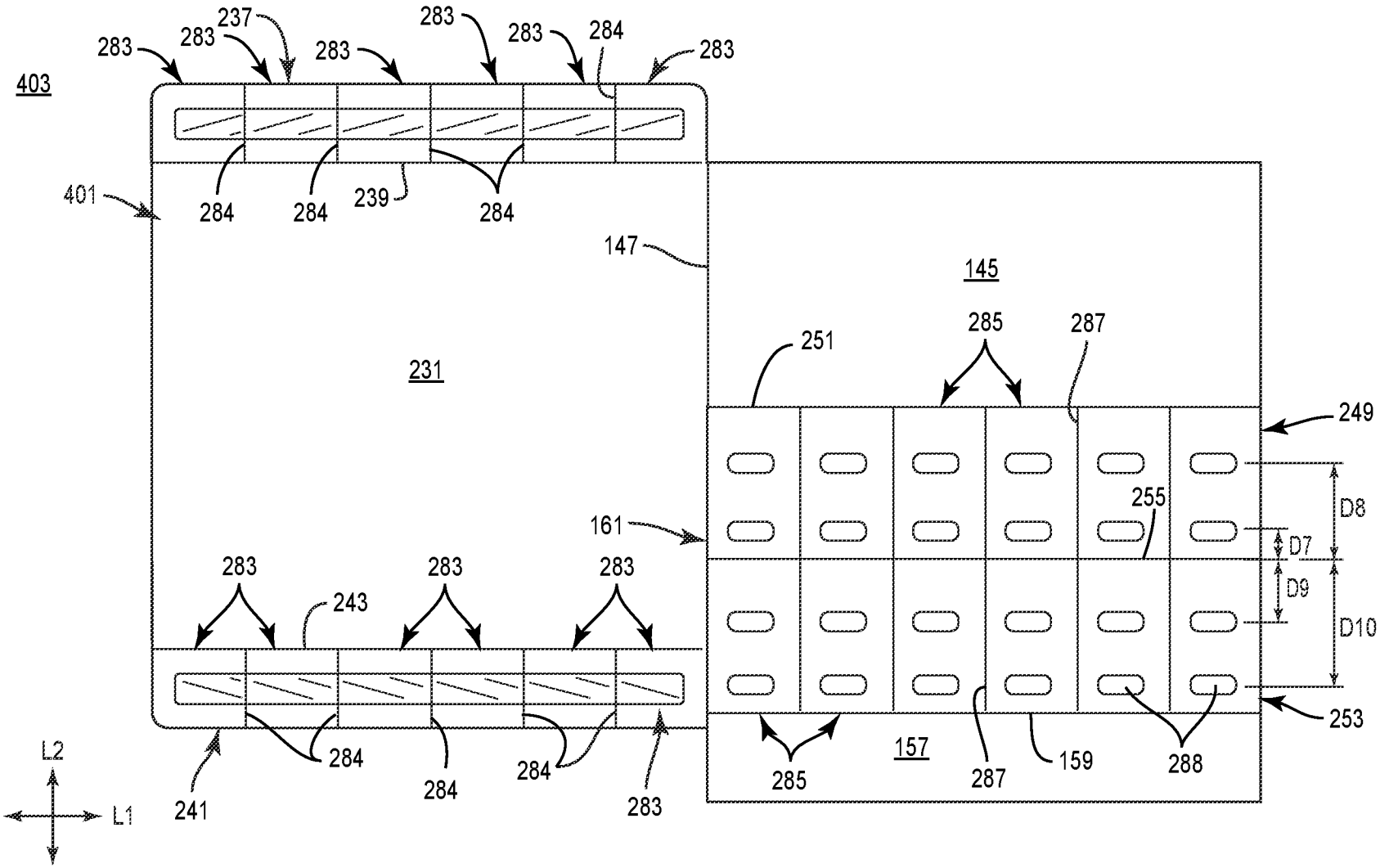
FIG. 14 is a plan schematic view of a construct blank for forming a shipping and dispensing construct according to a fourth exemplary embodiment of the disclosure.
Figure 15:
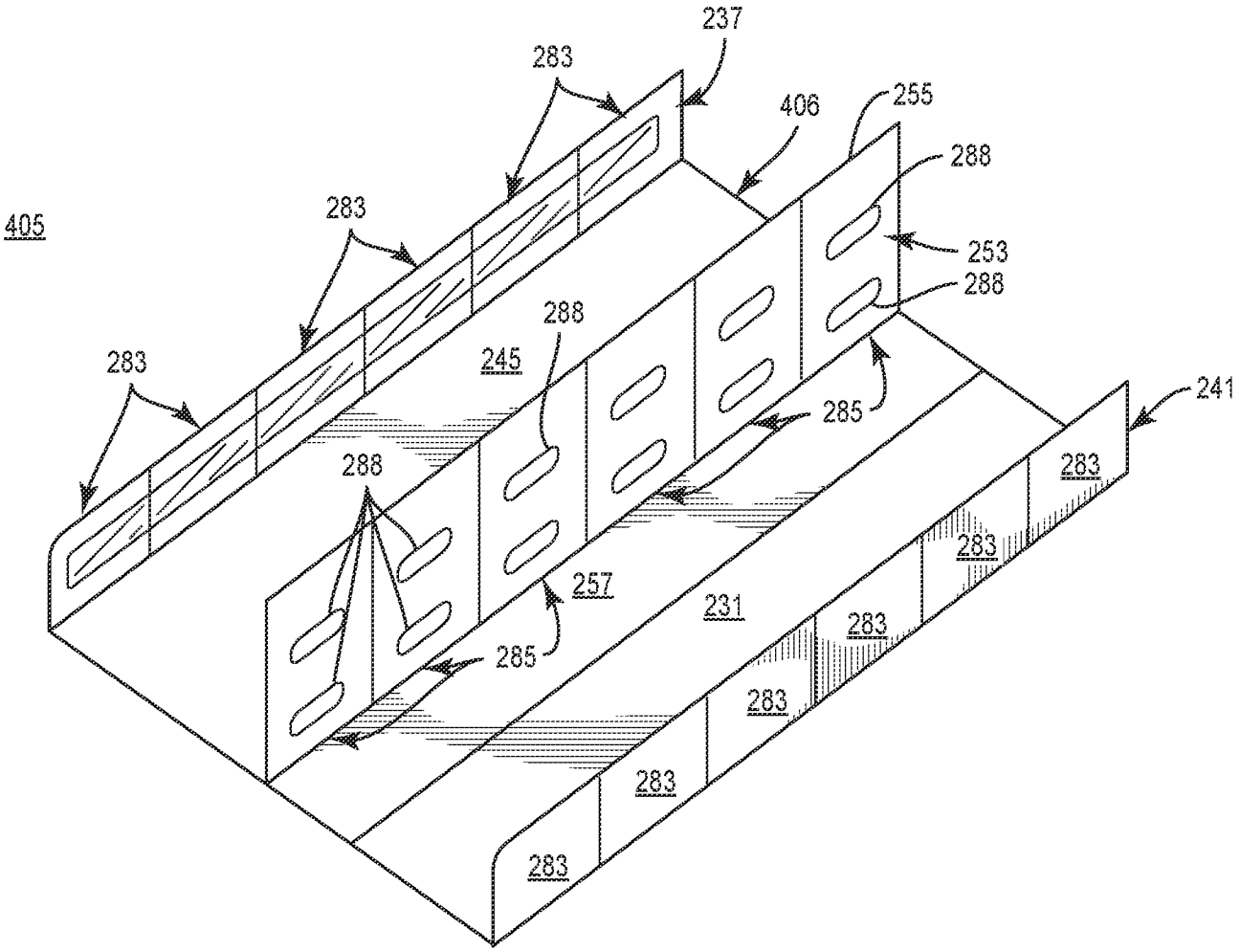
FIG. 15 is a perspective view of a shipping and dispensing construct formed from the blank of FIG. 14 according to the fourth exemplary embodiment of the disclosure.
Figure 16:
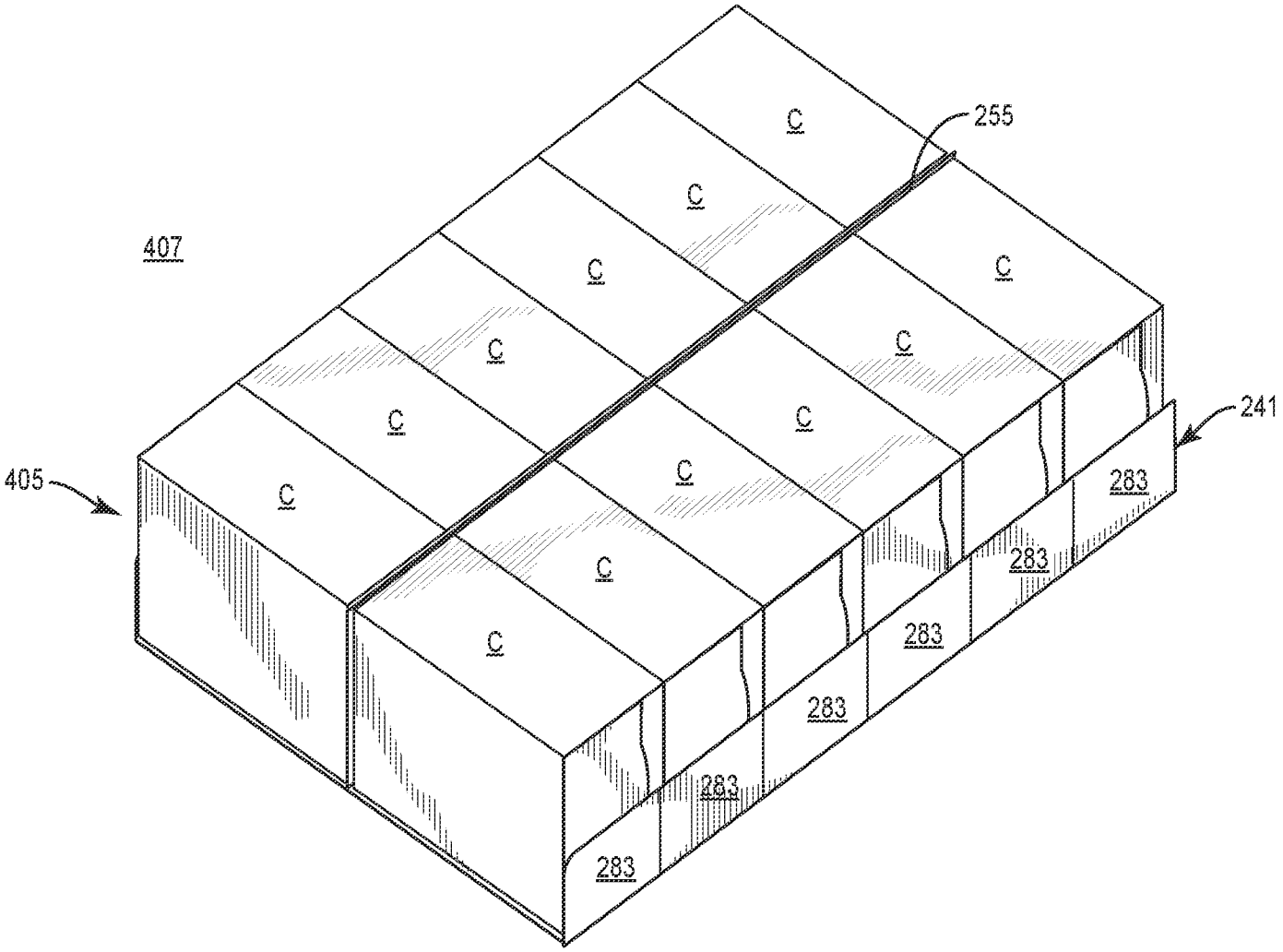
FIG. 16 is a perspective view of the shipping and dispensing construct of FIG. 15 further holding a plurality of product containers.
Figure 17:
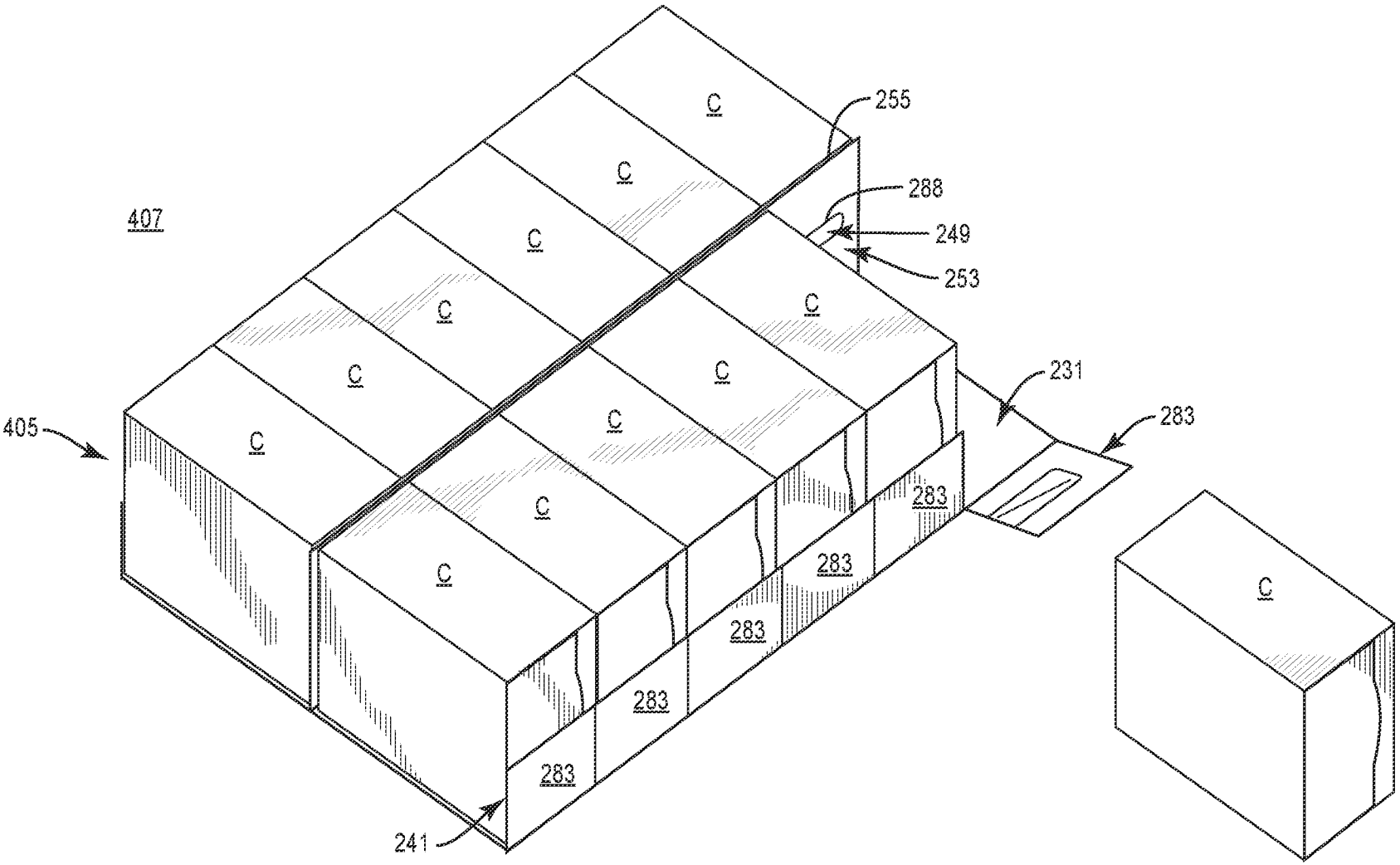
FIG. 17 is a perspective view of the shipping and dispensing construct as shown in FIG. 16, and having one or more product containers removed therefrom.

Turning to FIG. 14, an exterior surface 401 of a construct blank 403 for forming a shipping and dispensing construct 405 according to a fourth exemplary embodiment of the disclosure is illustrated. The construct blank 403 and the shipping and dispensing construct 405 (FIG. 15) formed therefrom can have one or more features that are the same or similar to those of the construct blank 103 and the shipping and dispensing construct 105 of the first exemplary embodiment, the construct blank 203 and the shipping and dispensing construct 205 of the second exemplary embodiment, and the construct blank 303 and the shipping and dispensing construct 305 of the third exemplary embodiment, and like or similar reference numerals are provided for like or similar features. The shipping and dispensing construct 405 can be provided together with one or more product holding containers C as a package 407 (FIG. 15).

As shown, the construct blank 403 has some features similar to the construct blanks 203, 303 in an arrangement similar to that of the construct blank 103. With regard to the central panels 249, 253, each central panel 249, 253 includes a plurality of separable/separably attached panel sections 285, each adjacent panel section 285 separable from one another at a respective lateral tear line 287, and each panel section 285 includes a respective pair of laterally spaced glue openings 288 In the illustrated embodiment, the central panel 249 includes a first row of glue openings 288 generally uniformly laterally spaced a distance D7 (broadly, "first distance") from the tear line 255, and a second row of glue openings 288 generally uniformly laterally spaced a distance D8 (broadly, "second distance") from the tear line 255, the distance D8 greater than the distance D7. Similarly, the central panel 253 can include a first row of glue openings 288 generally uniformly laterally spaced a distance D9 (broadly, "first distance") from the tear line 255, and a second row of glue openings 288 generally uniformly laterally spaced a distance D10 (broadly, "second distance") from the tear line 255, the distance D10 greater than the distance D9. As described further below, the arrangement of glue openings 288 across the central panels 253 can facilitate attachment of the product holding containers C to the construct 405.

In this regard, the shipping and dispensing construct 405 can be formed from the construct blank 403 in a manner similar to that described above with regard to the formation of the shipping and dispensing construct 105 from the construct blanks 103, 203, 303 e.g., such that the securing panels 245, 257 are positioned in at least partial face-to-face contact with the front panel 231, with the central panels 249, 253 positioned in at least partial face-to-face contact with each other and extending therefrom. Accordingly, the shipping and dispensing construct 405 extends at least partially around an interior 406 thereof for holding the product holding containers C.

Similar to that described above with regard to the construct blanks 203, 303 the glue openings of the central panel 249 can be positioned to be offset from the glue openings 288 of the central panel 253, e.g., due to the relatively different distances thereof from the tear line 255. In this regard, respective portions of the central panel 253 can be exposed through the glue openings 288 of the central panel 249, and respective portions of the central panel 249 can be exposed through the glue openings 288 of the central panel 253. Such exposed surfaces of the central panels 249, 253 through the respective glue openings 288 can provide surfaces for attachment, e.g., with and adhesive such as glue, for respective product holding containers C to the respective central panels 249, 253.

It will be understood that the central panels 249, 253 and/or glue openings 288 can have a different arrangement without departing from the disclosure. For example, the glue openings 288 of the central panel 249 and the glue openings 288 of the central panel 253 could be spaced uniform longitudinal distances from the tear line 255 so as to be aligned upon formation of the construct 205. In such an arrangement, communication between product holding containers C adjacent the central panel 249 and product holding containers C adjacent the central panel 253 could be provided through the aligned glue openings 288, e.g., to permit attachment of product holding containers C therethrough.

In this regard, the disclosed package 407/shipping and dispensing construct 405 provides for access and selective and modular or bulk dispensing of product holding container in a manner similar to that described above with regard to the package 107/construct 105, the package 207/construct 205, and the package 307/construct 305, and with similar advantages.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A shipping and dispensing construct for engaging a plurality of product holding containers, the shipping and dispensing construct comprising:

a plurality of panels extending at least partially around an interior of the shipping and dispensing construct and comprising a front panel, a top panel, at least one central panel extending from the front panel, and at least one side panel;

dispensing features for removal of one or more of the product holding containers, the dispensing features comprising a plurality of dispensing portions comprising at least a portion of the at least one central panel and a plurality of panel sections of the at least one side panel for being removably attached to a respective container of the plurality of containers, the dispensing portions for being removably attached to a respective container of the plurality of product holding containers and being separable from a remainder of the shipping and dispensing construct for allowing access to the respective container of the plurality of product holding containers.

2. The shipping and dispensing construct of claim 1, wherein the at least a portion of the at least one central panel comprises a plurality of panel sections of the at least one central panel for being removably attached to a respective container of the plurality of containers.

3. The shipping and dispensing construct of claim 2, wherein the at least one central panel is a first central panel, and the plurality of panels further comprises a second central panel in at least partial face-to-face contact with the first central panel and comprising a plurality of panel sections for being removably attached to a respective container of the plurality of product holding containers, the plurality of panel sections of the first central panel forming first central dispensing portions of the shipping and dispensing construct, and the plurality of panel sections of the second central panel forming second central dispensing portions of the shipping and dispensing construct.

4. The shipping and dispensing construct of claim 3, wherein the at least one side panel is a first side panel and the plurality of panels further comprises a second side panel comprising a plurality of panel sections, the plurality of panel sections of the first side panel forming first side dispensing portions of the shipping and dispensing construct, and the plurality of panel sections of the second side panel forming second side dispensing portions of the shipping and dispensing construct.

5. The shipping and dispensing construct of claim 2, wherein the dispensing features comprise an attachment tab separably connected to at least one panel section of the plurality of panel sections of the at least one central panel for attachment to a respective container of the plurality of product holding containers.

6. The shipping and dispensing construct of claim 5, wherein the dispensing features comprise a plurality of panel sections of the at least one side panel, and an attachment tab separably connected to at least one panel section of the plurality of panel sections of the at least one side panel and for being removably attached to a respective container of the plurality of product holding containers.

7. The shipping and dispensing construct of claim 1, wherein the at least one central panel comprises a plurality of glue openings for facilitating attachment of the plurality of product holding containers to the shipping and dispensing construct.

8. The shipping and dispensing construct of claim 7, wherein the at least one central panel is a first central panel and the plurality of panels further comprises a second central panel in at least partial face-to-face contact with the first central panel and foldably connected to the first central panel at a tear line, the plurality of glue openings of the first central panel are spaced a first distance from the tear line, the second central panel comprises a plurality of glue openings spaced a second distance from the tear line such that the glue openings of the first central panel are offset from respective glue openings of the second central panel.

9. The shipping and dispensing construct of claim 8, wherein a respective portion of the second central panel is exposed through the respective glue openings of the first central panel for attachment to a respective container of the plurality of product holding containers, and a respective portion of the first central panel is exposed through the respective glue openings of the second central panel for attachment to a respective container of the plurality of product holding containers.

10. The shipping and dispensing construct of claim 9, wherein the dispensing portion comprises a plurality of panel sections of the at least one side panel for being removably attached to a respective container of the plurality of product holding containers.

11. The shipping and dispensing construct of claim 10, wherein the at least one side panel is a first side panel comprising a plurality of panel sections for being removably attached to a respective container of the plurality of containers and forming first central dispensing portions of the shipping and dispensing construct, the plurality of panels further comprises a second side panel comprising a plurality of panel sections for being removably attached to a respective container of the plurality of containers and forming second central dispensing portions of the shipping and dispensing construct, the plurality of panel sections of the first side panel forming first side dispensing portions of the shipping and dispensing construct, and the plurality of panel sections of the second side panel forming second side dispensing portions of the shipping and dispensing construct.

12. A construct blank for forming a shipping and dispensing construct for engaging a plurality of product holding containers, the construct blank comprising:

a plurality of panels for extending at least partially around an interior of the shipping and dispensing construct formed from the construct blank and comprising a front panel, a top panel, at least one central panel for extending from the front panel when the shipping and dispensing construct is formed from the construct blank, and at least one side panel;

dispensing features for removal of one or more of the product holding containers from the shipping and dispensing construct formed from the construct blank, the dispensing features comprising a plurality of dispensing portions comprising at least a portion of the at least one central panel and a plurality of panel sections of the at least one side panel for being removably attached to a respective container of the plurality of containers, the dispensing portions for being removably attached to a respective container of the plurality of product holding containers and being separable from a remainder of the construct blank for allowing access to the respective container of the plurality of product holding containers when the shipping and dispensing construct is formed from the construct blank.

13. The construct blank of claim 12, wherein the at least a portion of the at least one central panel comprises a plurality of panel sections of the at least one central panel for being removably attached to a respective container of the plurality of containers when the shipping and dispensing construct is formed from the construct blank.

14. The construct blank of claim 13, wherein the at least one central panel is a first central panel, and the plurality of panels further comprises a second central panel comprising a plurality of panel sections for being removably attached to a respective container of the plurality of product holding containers when the shipping and dispensing construct is formed from the construct blank, the plurality of panel sections of the first central panel forming first central dispensing portions of the construct blank, and the plurality of panel sections of the second central panel forming second central dispensing portions of the construct blank.

15. The construct blank of claim 14, wherein the at least one side panel is a first side panel and the plurality of panels further comprises a second side panel comprising a plurality of panel sections, the plurality of panel sections of the first side panel forming first side dispensing portions of the construct blank, and the plurality of panel sections of the second side panel forming second side dispensing portions of the construct blank.

16. The construct blank of claim 13, wherein the dispensing features comprise an attachment tab separably connected to at least one panel section of the plurality of panel sections of the at least one central panel for attachment to a respective container of the plurality of product holding containers when the shipping and dispensing construct is formed from the construct blank.

17. The construct blank of claim 16, wherein the dispensing features comprise a plurality of panel sections of the at least one side panel, and an attachment tab separably connected to at least one panel section of the plurality of panel sections of the at least one side panel and for being removably attached to a respective container of the plurality of product holding containers when the shipping and dispensing construct is formed from the construct blank.

18. The construct blank of claim 12, wherein the at least one central panel comprises a plurality of glue openings for facilitating attachment of the plurality of product holding containers to the shipping and dispensing construct when the shipping and dispensing construct is formed from the construct blank.

19. The construct blank of claim 18, wherein the at least one central panel is a first central panel and the plurality of panels further comprises a second central panel in at least partial face-to-face contact with the first central panel and foldably connected to the first central panel at a tear line, the plurality of glue openings of the first central panel are spaced a first distance from the tear line, the second central panel comprises a plurality of glue openings spaced a second distance from the tear line.

20. The construct blank of claim 19, wherein the dispensing portion comprises a plurality of panel sections of the at least one side panel for being removably attached to a respective container of the plurality of product holding containers when the shipping and dispensing construct is formed from the construct blank.

21. The construct blank of claim 20, wherein the at least one side panel is a first side panel comprising a plurality of panel sections removably attached to a respective container of the plurality of containers when the shipping and dispensing construct is formed from the construct blank and forming first central dispensing portions of the construct blank, the plurality of panels further comprises a second side panel comprising a plurality of panel sections removably attached to a respective container of the plurality of containers when the shipping and dispensing construct is formed from the construct blank and forming second central dispensing portions of the construct blank, the plurality of panel sections of the first side panel forming first side dispensing portions of the construct blank, and the plurality of panel sections of the second side panel forming second side dispensing portions of the construct blank.

22. A method of forming a shipping and dispensing construct, the method comprising:

obtaining a construct blank comprising a plurality of panels comprising a front panel, a top panel, at least one central panel, and at least one side panel, and dispensing features comprising a plurality of dispensing portions, the plurality of dispensing portions comprising at least a portion of the at least one central panel and a plurality of panel sections of the at least one side panel for being removably attached to a respective container of the plurality of containers, the dispensing portions being separable from a remainder of the blank; and folding the plurality of panels at least partially around an interior of the shipping and dispensing construct formed from the construct blank such that the dispensing portions are positioned for being removably attached to a respective container of a plurality of product holding containers and such that the at least one central panel extends from the front panel.

23. The method of claim 22, further comprising removably attaching the plurality of product holding containers to respective dispensing portions of the shipping and dispensing construct.

24. The method of claim 23, further comprising separating one or more of the dispensing portions from the remainder of the shipping and dispensing construct.

25. The method of claim 22, wherein the at least a portion of the at least one central panel comprises a plurality of panel sections of the at least one central panel for being removably attached to a respective container of the plurality of containers.

26. The method of claim 25, wherein the at least one central panel is a first central panel, and the plurality of panels further comprises a second central panel in at least partial face-to-face contact with the first central panel and comprising a plurality of panel sections for being removably attached to a respective container of the plurality of product holding containers, the plurality of panel sections of the first central panel forming first central dispensing portions of the shipping and dispensing construct, and the plurality of panel sections of the second central panel forming second central dispensing portions of the shipping and dispensing construct.

27. The method of claim 26, wherein the at least one side panel is a first side panel and the plurality of panels further comprises a second side panel comprising a plurality of panel sections, the plurality of panel sections of the first side panel forming first side dispensing portions of the shipping and dispensing construct, and the plurality of panel sections of the second side panel forming second side dispensing portions of the shipping and dispensing construct.

28. The method of claim 25, wherein the dispensing features comprise an attachment tab separably connected to at least one panel section of the plurality of panel sections of the at least one central panel for attachment to a respective container of the plurality of product holding containers.

29. The method of claim 28, wherein the dispensing features comprise a plurality of panel sections of the at least one side panel, and an attachment tab separably connected to at least one panel section of the plurality of panel sections of the at least one side panel and for being removably attached to a respective container of the plurality of product holding containers.

30. The method of claim 22, wherein the at least one central panel comprises a plurality of glue openings for facilitating attachment of the plurality of product holding containers to the shipping and dispensing construct.

31. The method of claim 30, wherein the at least one central panel is a first central panel and the plurality of panels further comprises a second central panel in at least partial face-to-face contact with the first central panel and foldably connected to the first central panel at a tear line, the plurality of glue openings of the first central panel are spaced a first distance from the tear line, the second central panel comprises a plurality of glue openings spaced a second distance from the tear line such that the glue openings of the first central panel are offset from respective glue openings of the second central panel when the plurality of panels are folded.

32. The method of claim 31, wherein a respective portion of the second central panel is exposed through the respective glue openings of the first central panel for attachment to a respective container of the plurality of product holding containers, and a respective portion of the first central panel is exposed through the respective glue openings of the second central panel for attachment to a respective container of the plurality of product holding containers.

33. The method of claim 32, wherein the dispensing portion comprises a plurality of panel sections of the at least one side panel for being removably attached to a respective container of the plurality of product holding containers.

34. The method of claim 33, wherein the at least one side panel is a first side panel comprising a plurality of panel sections removably attached to a respective container of the plurality of containers and forming first central dispensing portions of the shipping and dispensing construct, the plurality of panels further comprises a second side panel comprising a plurality of panel sections removably attached to a respective container of the plurality of containers and forming second central dispensing portions of the shipping and dispensing construct, the plurality of panel sections of the first side panel forming first side dispensing portions of the shipping and dispensing construct, and the plurality of panel sections of the second side panel forming second side dispensing portions of the shipping and dispensing construct.

35. A package comprising:

a plurality of product holding containers; and a shipping and dispensing construct engaged with the plurality of product holding containers, the shipping and dispensing construct comprising:

a plurality of panels extending at least partially around an interior of the shipping and dispensing construct and comprising a front panel, a top panel, at least one central panel extending from the front panel, and at least one side panel;

dispensing features for removal of one or more of the product holding containers, the dispensing features comprising a plurality of dispensing portions comprising at least a portion of the at least one central panel and a plurality of panel sections of the at least one side panel removably attached to a respective container of the plurality of containers, the dispensing portions being removably attached to a respective container of the plurality of product holding containers and being separable from a remainder of the shipping and dispensing construct for allowing access to the respective container of the plurality of product holding containers.

36. The package of claim 35, wherein the at least a portion of the at least one central panel comprises a plurality of panel sections of the at least one central panel removably attached to a respective container of the plurality of containers.

37. The package of claim 36, wherein the at least one central panel is a first central panel, and the plurality of panels further comprises a second central panel in at least partial face-to-face contact with the first central panel and comprising a plurality of panel sections removably attached to a respective container of the plurality of product holding containers, the plurality of panel sections of the first central panel forming first central dispensing portions of the shipping and dispensing construct, and the plurality of panel sections of the second central panel forming second central dispensing portions of the shipping and dispensing construct.

38. The package of claim 37, wherein the at least one side panel is a first side panel and the plurality of panels further comprises a second side panel comprising a plurality of panel sections, the plurality of panel sections of the first side panel forming first side dispensing portions of the shipping and dispensing construct, and the plurality of panel sections of the second side panel forming second side dispensing portions of the shipping and dispensing construct.

39. The package of claim 36, wherein the dispensing features comprise an attachment tab separably connected to at least one panel section of the plurality of panel sections of the at least one central panel attached to a respective container of the plurality of product holding containers.

40. The package of claim 39, wherein the dispensing features comprise a plurality of panel sections of the at least one side panel, and an attachment tab separably connected to at least one panel section of the plurality of panel sections of the at least one side panel and removably attached to a respective container of the plurality of product holding containers.

41. The package of claim 35, wherein the at least one central panel comprises a plurality of glue openings facilitating attachment of the plurality of product holding containers to the shipping and dispensing construct.

42. The package of claim 41, wherein the at least one central panel is a first central panel and the plurality of panels further comprises a second central panel in at least partial face-to-face contact with the first central panel and foldably connected to the first central panel at a tear line, the plurality of glue openings of the first central panel are spaced a first distance from the tear line, the second central panel comprises a plurality of glue openings spaced a second distance from the tear line such that the glue openings of the first central panel are offset from respective glue openings of the second central panel.

43. The package of claim 42, wherein a respective portion of the second central panel is exposed through the respective glue openings of the first central panel and attached to a respective container of the plurality of product holding containers, and a respective portion of the first central panel is exposed through the respective glue openings of the second central panel and attached to a respective container of the plurality of product holding containers.

44. The package of claim 43, wherein the dispensing portion comprises a plurality of panel sections of the at least one side panel removably attached to a respective container of the plurality of product holding containers.

45. The package of claim 44, wherein the at least one side panel is a first side panel comprising a plurality of panel sections removably attached to a respective container of the plurality of containers and forming first central dispensing portions of the shipping and dispensing construct, the plurality of panels further comprises a second side panel comprising a plurality of panel sections removably attached to a respective container of the plurality of containers and forming second central dispensing portions of the shipping and dispensing construct, the plurality of panel sections of the first side panel forming first side dispensing portions of the shipping and dispensing construct, and the plurality of panel sections of the second side panel forming second side dispensing portions of the shipping and dispensing construct.

* * * * *